US008084175B2

(12) United States Patent
Hirose et al.

(10) Patent No.: US 8,084,175 B2
(45) Date of Patent: Dec. 27, 2011

(54) ELECTROPHOTOGRAPHIC TONER SET

(75) Inventors: Naohiro Hirose, Tokyo (JP); Kaori Soeda, Tokyo (JP); Shinya Obara, Tokyo (JP); Tatsuya Fujisaki, Tokyo (JP); Yohei Ohno, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 343 days.

(21) Appl. No.: 12/468,092

(22) Filed: May 19, 2009

(65) Prior Publication Data

US 2009/0291378 A1 Nov. 26, 2009

(30) Foreign Application Priority Data

May 23, 2008 (JP) ..... 2008-135429

(51) Int. Cl.
*G03G 9/00* (2006.01)

(52) U.S. Cl. ..... 430/107.1; 430/108.1

(58) Field of Classification Search ..... 430/107.1, 430/108.1

See application file for complete search history.

(56) References Cited

U.S. PATENT DOCUMENTS 5,556,727 A * 9/1996 Ciccarelli et al. ..... 430/45.55

(Continued)

*Primary Examiner* — Mark Chapman

(74) *Attorney, Agent, or Firm* — Lucas & Mercanti, LLP

(57) ABSTRACT

Provided is a set of toners comprising a yellow toner, a magenta toner, a cyan toner and a black toner for forming a full color image with an electrophotographic method, wherein the yellow toner comprises toner particles containing at east one pigment selected from the group consisting of C. I. Pigment Yellow 74, C. I. Pigment Yellow 139, C. I. Pigment Yellow 180, C. I. Pigment Yellow 185 and C. I. Pigment Yellow 155; the magenta toner comprises toner particles containing a rhodamine based dye represented at least by Formula (1) and Formula (2), and the cyan toner comprises toner particles containing a phthalocyanine based dye represented by Formula (5):

Formula (1)

Formula (2)

(X⁻),

Formula (5)

11 Claims, 3 Drawing Sheets

U.S. PATENT DOCUMENTS

2004/0248025 A1* 12/2004 Miyakawa ..... 430/107.1
2006/0019187 A1* 1/2006 Nakamura ..... 430/108.1
2006/0160009 A1* 7/2006 Padunchwit et al. .... 430/108.23
2007/0218395 A1* 9/2007 Winters ..... 430/111.41

* cited by examiner

ELECTROPHOTOGRAPHIC TONER SET

This application is based on Japanese Patent Application No. 2008-135429 filed on May 23, 2008 with Japan Patent Office, the entire content of which is hereby incorporated by reference.

TECHNICAL FIELD

The present invention relates to a method for forming a full color image and a full color toner set (it is also called a color toner kit) comprising a yellow toner, a magenta toner, a cyan toner and a black toner for forming a full color image with an electrophotographic method.

BACKGROUND

In recent years, production of a full color print can be achieved via the electrophotography system using the toner for electrostatic charge image development (hereinafter it is called as an electrophotographic toner or simply a toner) in addition to a monochrome print which is most representative for a document print. Since such full color image forming apparatus can produce a required number of prints on demand without preparing a printing plate for a usual printing process, it is increasingly used in a small volume printing field having many opportunities of small-quantity print order (for example, refer to Patent Document 1).

In producing a full color print, such as a catalog and an advertisement print, with a toner, the toner used is required to produce an image which exhibits a faithful color reproduction to the original. In full color image formation, yellow, magenta and cyan color toners each are superimposed to reproduce a target color image. In order to realize faithful color reproduction, it was required for the color toners to improve the color reproduction property.

Therefore, investigation of various colorants has so far been made for the purpose of improving the color reproduction of a color toner.

An example of typical magenta colorants for color toners is a quinacridone pigment. The toner incorporating a quinacridone pigment has outstanding light resistance and has a preferable magenta toner, therefore, a quinacridone pigment is used for general-purpose. However, this quinacridone pigment has a problem of dispersibility and the toner incorporating a quinacridone pigment tends to produce a turbid color at the time of a color pile. It is difficult to satisfy the request to produce a print of the image of the computer graphics or the high saturation display which are becoming highly required in recent years.

Instead of using solely a quinacridone pigment, the system in which other dye is added to a quinacridone pigment is known in order to increase color saturation (for example, refer to Patent Document 1). Furthermore, the proposal is made also about the system which uses a combination of a quinacridone pigment and a naphthol pigment (for example, refer to Patent Document 2).

Moreover, it is also known the combined use with an anthraquinone pigment (for example, refer to Patent Document 3).

However, all of these proposed systems are inferior in light resistance to the system solely using a quinacridone pigment which exhibits high light resistance as a magenta pigment. They had a problem which cannot keep the color stable when the print is used over a long period of time.

Furthermore, in order to form an image with higher color saturation, a proposal is made in which the toner incorporating the coloring matter composed of a metallic compound and a dye (for example, Patent Document 4).

However, it is difficult to secure a large color region because, even if a certain specific color region is expanded and color saturation is increased, color saturation balances tend to be lowered. Especially, when color reproduction according to a display was performed, there occurs a problem that only a specific color region is approaching to the color reproduction range of sRGB used as a standard made by IEC (International Electrotechnical Commission) in October 1998), and color reproduction in all of the color regions cannot be performed.

Patent Document 1: Unexamined Japanese patent application publication (hereafter it is called as JP-A) 2007-286148

Patent Document 2: JP-A 2006-267741

Patent Document 3: JP-A 2006-154363

Patent Document 4: JP-A 2007-316591

SUMMARY

An object of the present invention is to provide an image formation method and a set of color toners which enable to produce a preferable full color image having a wide color reproduction range, especially to produce a color image achieving a color reproduction range of a display which is approaching nearer to sRGB reproduction region.

The above object has been attained by the following constitutions:

1. A set of toners comprising a yellow toner, a magenta toner, a cyan toner and a black toner for forming a full color image with an electrophotographic method, wherein the yellow toner comprises toner particles containing at least one pigment selected from the group consisting of C. I. Pigment Yellow 74, C. I. Pigment Yellow 139, C. I. Pigment Yellow 180, C. I. Pigment Yellow 185 and C. I. Pigment Yellow 155;

the magenta toner comprises toner particles containing a rhodamine based dye represented at least by Formula (1) and Formula (2), and the cyan toner comprises toner particles containing a phthalocyanine based dye represented by Formula (5):

Formula (1)

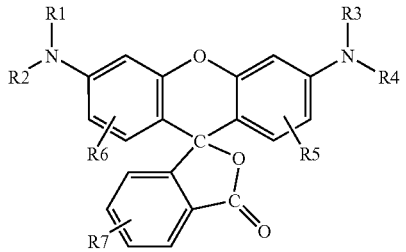

wherein R1 to R4 and R5 to R7 each independently represents a hydrogen atom or an alkyl group of 1 to 4 carbon atoms;

Formula (2)

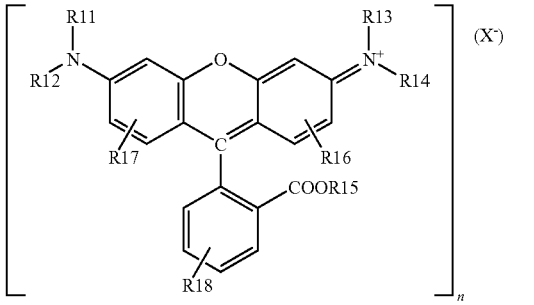

wherein R11 to R14 and R16 to R18 each independently represents a hydrogen atom or an alkyl group of 1 to 4 carbon atoms, R15 represents a hydrogen atom or an alkyl group of 1 to 12 carbon atoms, ($X^-$) represents a counter anion represented by any one of a chlorine ion, a bromine ion, a sulfate ion, Formula (3) and Formula (4), and n is an integer of 1 or 2;

Formula (3)

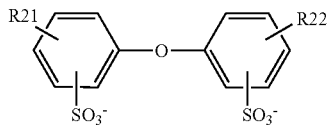

wherein R21 and R22 each independently represents an alkyl group of 1 to 22 carbon atoms;

Formula (4)

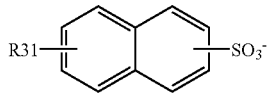

wherein R31 represents an alkyl group of 1 to 22 carbon atoms;

Formula (5)

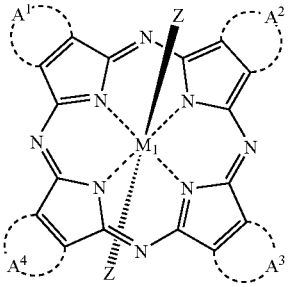

wherein $M_1$ represents any one of silicon atom, germanium atom, tin atom; each Z independently represents a hydroxyl group, a chlorine atom, an aryloxy group of 6 to 18 carbon atoms, an alkoxy group of 1 to 22 carbon atoms and a group represented by Formula (6); $A^1$, $A^2$, $A^3$ and $A^4$ each independently represents a methyl group or an atomic group which forms an aromatic group having electron controllable group; and Formula (6)

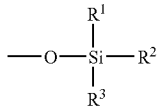

wherein $R^1$, $R^2$, $R^3$ represents an alkyl group of 1 to 22 carbon atoms, an aryl group of 6 to 18 carbon atoms, an alkoxy group of 1 to 22 carbon atoms or an aryloxy group of 6 to 18 carbon atoms and $R^1$, $R^2$, $R^3$ each may be the same or different.

2. The set of toners of item 1, wherein $M_1$ in Formula (5) comprises a silicon atom.
3. The set of toners of item 1, wherein A1, A2, A3, and A4 in Formula (5) all comprises atom groups forming a benzene ring.
4. The set of toners of item 1 wherein Z comprises a group represented by Formula (6).
5. The set of toners of item 4, wherein $R^1$, $R^2$, $R^3$ in Formula (6) each independently comprises an alkyl group of 1 to 22 carbon atoms.
6. The set of toners of item 4, wherein $R^1$, $R^2$, $R^3$ in Formula (6) each independently comprises an alkyl group of 1 to 6 carbon atoms.
7. The set of toners of item 1, wherein R5, R6, R7 in Formula (1) each comprises a hydrogen atom.
8. The set of toners of item 1, wherein R16, R17, R18 in Formula (2) each comprises a hydrogen atom.
9. The set of toners of item 1, wherein R15 in Formula (2) each comprises a hydrogen atom or an alkyl group of 1 to 4 carbon atoms.
10. An electrophotographic image forming apparatus comprising the set of toners of item 1.
11. A method for forming a color image using the electrophotographic image forming apparatus of item 10.

The inventors, as a result of close examination, could ensure color reproduction, which is close to a display, by employing and combining specific colorants for each color of yellow, magenta and cyan. Namely, inventors found that it is not important to enlarge the color gamut by employing colorants, each of which simply exhibits the wider color gamut, but it is important to select colorants of each color in consideration of a balance of color reproduction. The color reproduction range of a display, sRGB, exhibits the very wide color gamut in a blue region. However, if the color reproduction range of the blue is the one which is emphasized, when a color is formed in an additive color system, a green region is enlarged so that the color gamut of a yellow or cyan part tends to cause a deformation to result in color imbalance. As a result, images with color reproduction giving uncomfortable feeling to observers are formed, even though the color reproduction range is enlarged.

The inventors, as a result of close examination, could enlarge the color gamuts of green (the range having a hue angle of about 135 degrees) and magenta (the range having a hue angle of about 315 degrees) by employing a combination of such colorants, compared to a combination of conventional colorants, with the color gamuts of red (the range having a hue angle of about 45 degrees) and cyan (the range having a hue angle of about 225 degrees) having remained unchanged. Further, the inventors could enlarge the color gamut of cyan (the range having a hue angle of about 225 degrees) more than that of the sRGB, while allowing red (the range having a hue angle of about 45 degrees), green (the range having a hue angle of about 135 degrees), and magenta (the range having a hue angle of about 315 degrees) to exhibit smaller color gamut than that of the sRGB. As a result, it is assumed that balances among color gamuts of each color (yellow, magenta, cyan, blue, red, and green) could be improved, and then, the deviation of color reproduction could be suppressed, and as a result, a wider color reproduction range was ensured, as well as excellent color balances were ensured.

DESCRIPTION OF THE PREFERRED EMBODIMENTS

Figure 1:
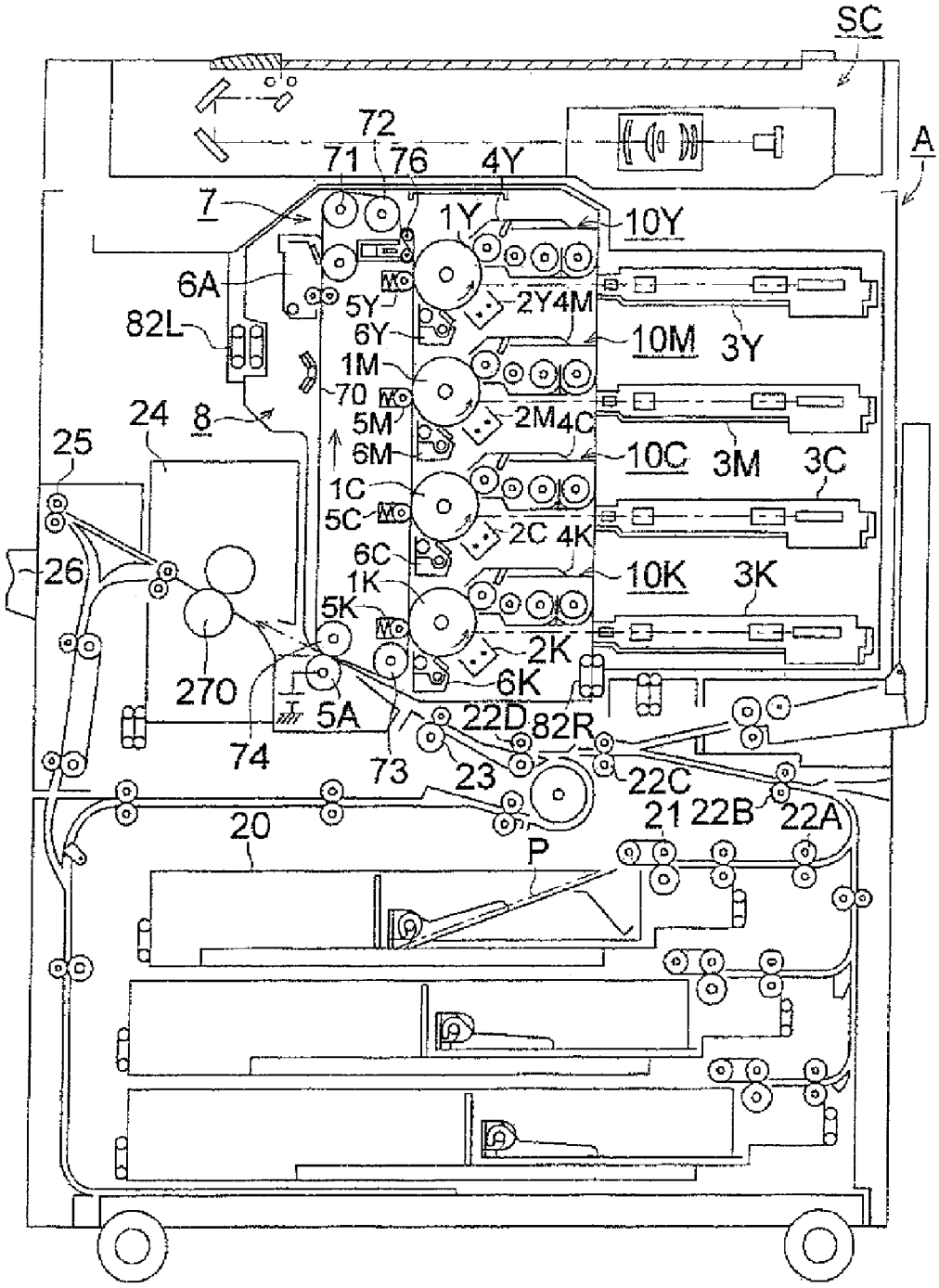
FIG. 1: A schematic view showing an example of an image forming apparatus employing the toner of the present invention as a two-component developing system

The method for forming images of the present invention is to form a full-color image employing at least a yellow toner, a magenta toner, a cyan toner, and a black toner, and the method is characterized in that the aforesaid yellow toner is comprised of a yellow toner selected from a group consisting at least of C. I. Pigment Yellow 74, C. I. Pigment Yellow 139, C. I. Pigment Yellow 180, C. I. Pigment Yellow 185 and C. I. Pigment Yellow 155, a magenta toner is comprised of a rhodamine based dye represented at least by Formulae (1) and (2) below, and a cyan toner is comprised of a phthalocyanine based dye represented by Formula (5).

The full-color set of the present invention is a combination of toners fabricated by employing the above specific colorants of each color of yellow, magenta, and cyan.

The yellow colorant employed in the present invention is selected from a group of the specific 5 kinds of pigment yellow. Any of these colorants exhibit a wide color region, and assures a wider color region than a color reproduction range of a display.

Further, the cyan colorant employed in the present invention is a phthalocyanine having a specific structure, and exhibits a wider color gamut compared to a commonly used copper phthalocyanine or non-metal phthalocyanine.

The magenta colorant is a rhodamine based dye. Although this colorant (hereinafter also referred to as a coloring agent) exhibits a larger color gamut compared to a commonly used quinacridone based pigment, the above colorant exhibits a smaller color gamut compared to the magenta color gamut stipulated by the sRGB.

By employing a combination of such colorants, the color gamuts of green (the range having a hue angle of about 135 degrees) and magenta (the range having a hue angle of about 315 degrees) can be enlarged, compared to a combination of conventional colorants, with the color gamuts of red (the range having a hue angle of about 45 degrees) and cyan (the range having a hue angle of about 225 degrees) having remained unchanged. Further, the inventors could enlarge the color gamut of cyan (the range having a hue angle of about 225 degrees) more than that of the sRGB, while allowing red (the range having a hue angle of about 45 degrees), green (the range having a hue angle of about 135 degrees), and magenta (the range having a hue angle of about 315 degrees) to exhibit smaller color gamut than that of the sRGB. As a result, it is assumed that balances among color gamuts of each color (yellow, magenta, cyan, blue, red, and green) could be improved, and then, the deviation of color reproduction could be suppressed, and as a result, a wider color reproduction range was assured, as well as excellent color balances were assured.

First, specific coloring agents employed in the present invention will be described.

<<Coloring Agent>>

<Coloring Agent for Yellow Toner>

Coloring agents for a yellow toner include yellow pigments selected from a group consisting of C. I. Pigment Yellow 74, C. I. Pigment Yellow 139, C. I. Pigment Yellow 180, C. I. Pigment Yellow 185 and C. I. Pigment Yellow 155.

<Coloring Agent for Magenta Toner>

Coloring agents for a magenta toner include rhodamine based dyes represented by Formula (1) or (2).

Formula (1)

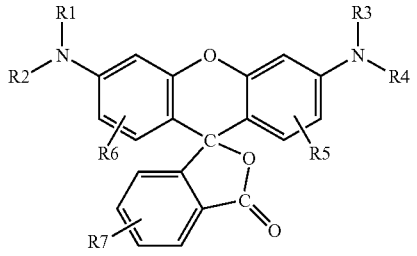

In above Formula (1), R1 to R4, and R5 to R7 represent a hydrogen atom or an alkyl group of 1 to 4 carbon atoms.

Formula (2)

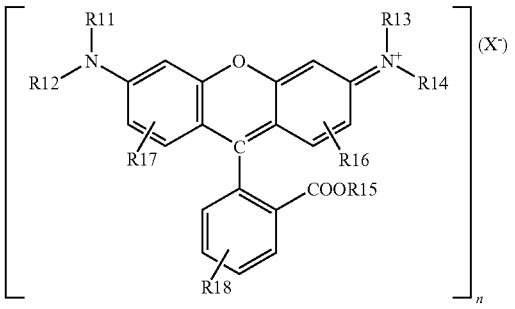

In above Formula (2), R11 to R14, and R16 to R18 represent a hydrogen atom or an alkyl group of 1 to 4 carbon atoms, R15 represents a hydrogen atom or an alkyl group of 1 to 12 carbon atoms, and ($X^-$) is a counter anion representing any one of a chlorine ion, a bromine ion, an iodine ion, a sulfate ion, Formula (3), or Formula (4).

Formula (3)

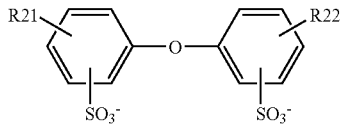

In above Formula (3) R21 and R22 represent an alkyl group of 1 to 22 carbon atoms.

Formula (4)

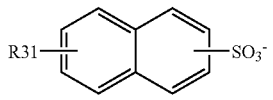

In above Formula (4), R31 represents an alkyl group of 1 to 22 carbon atoms.

Compounds represented by above Formulae (1) and (2) are shown below as illustrated compounds, but compounds usable for the toner of the present invention are not limited to them.

A-1
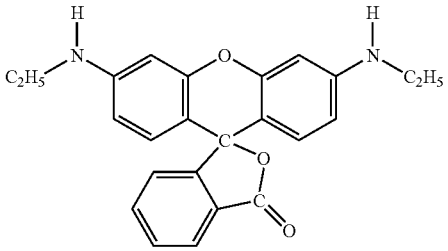
A-2
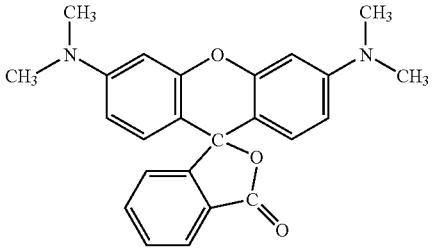
A-3
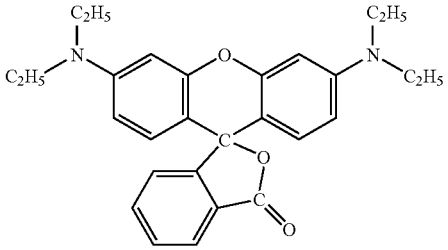
A-4
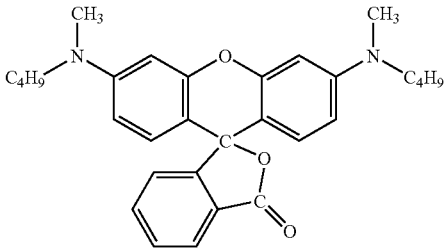
A-5
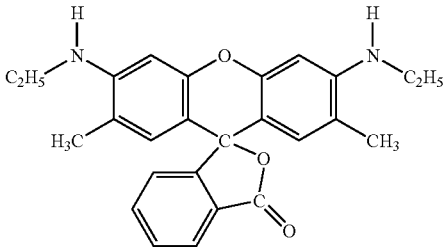
A-6
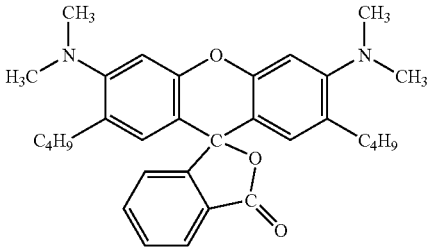
-continued
A-7
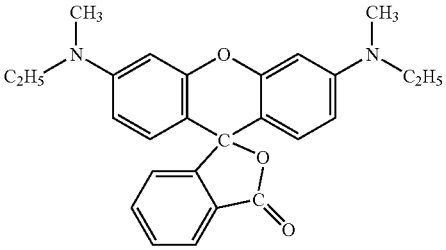
A-8
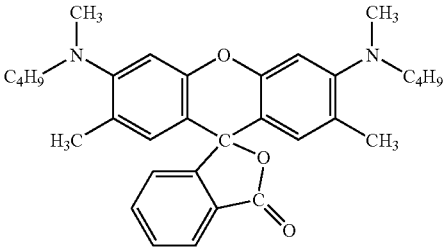
A-9
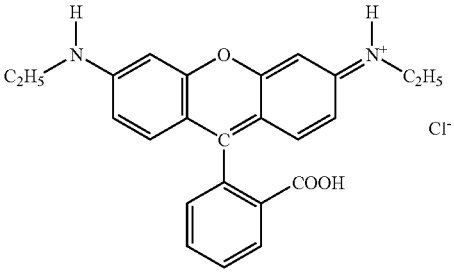
A-10
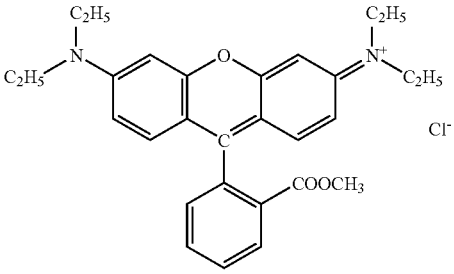
A-11
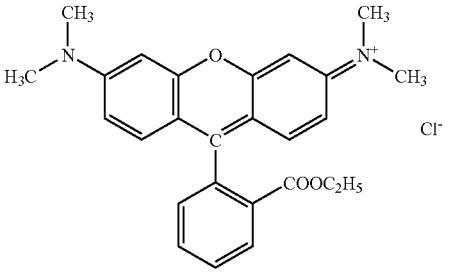
A-12
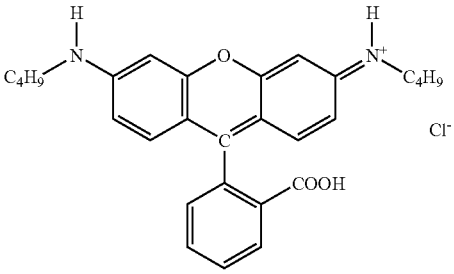

-continued
A-13
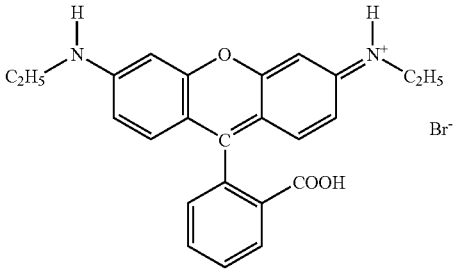
A-14
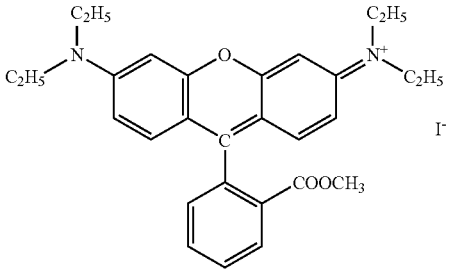
A-15
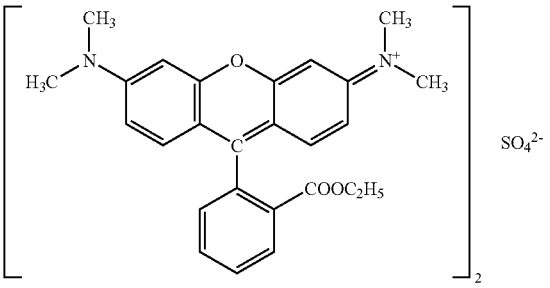
A-16
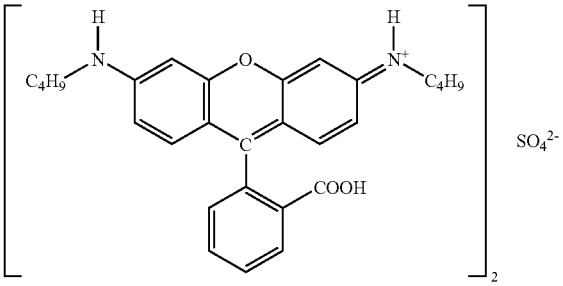
A-17
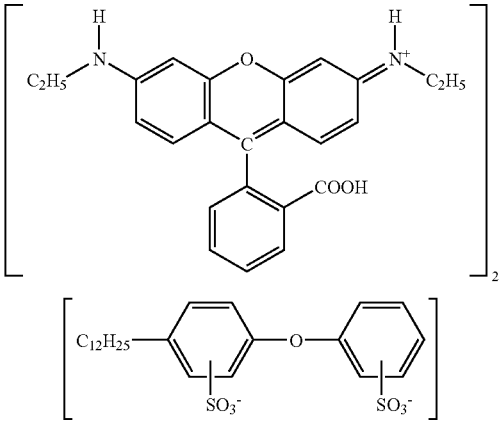
-continued
A-18
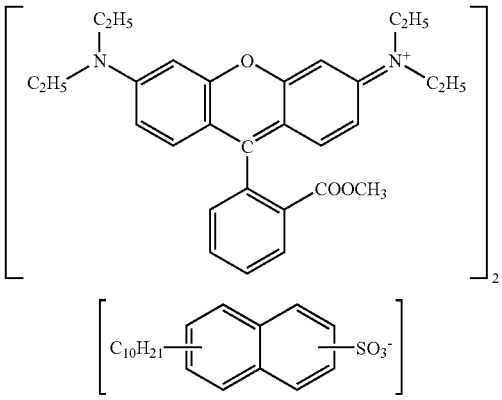
A-19
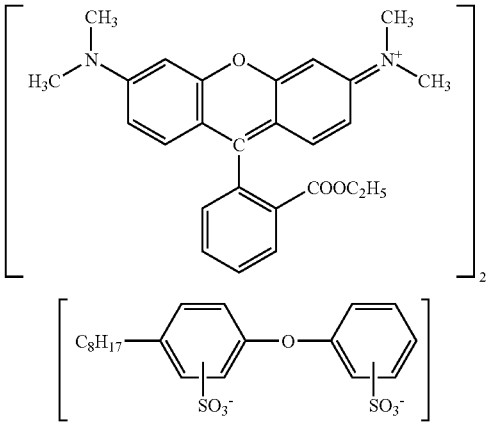
A-20
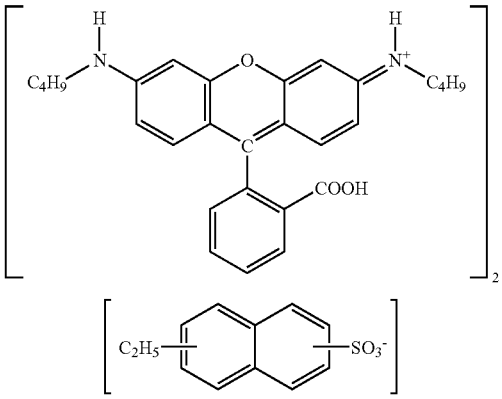

-continued

A-21

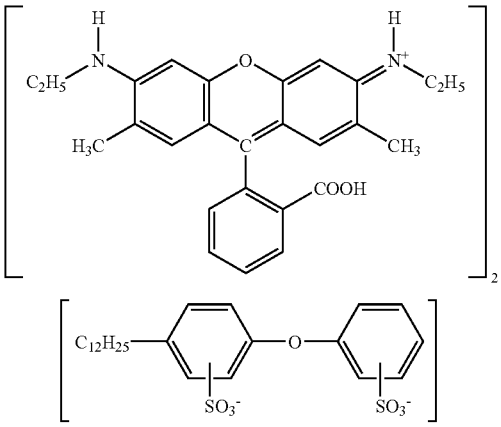

A-22

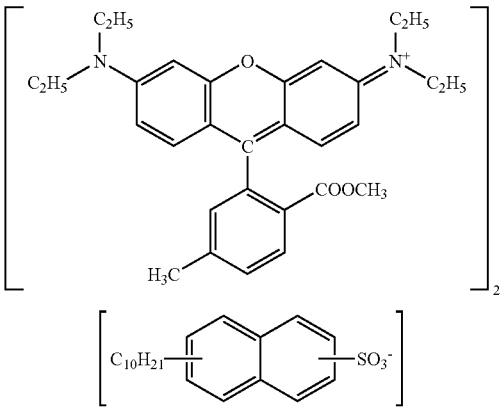

A-23

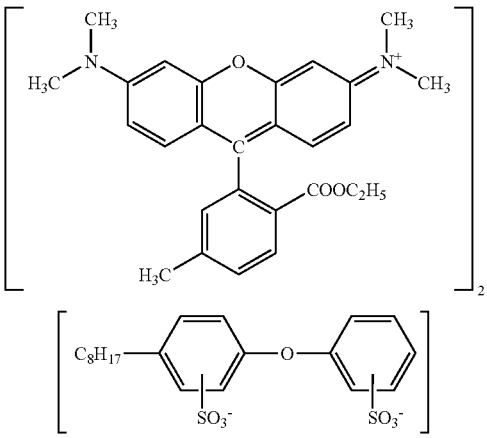

-continued

A-24

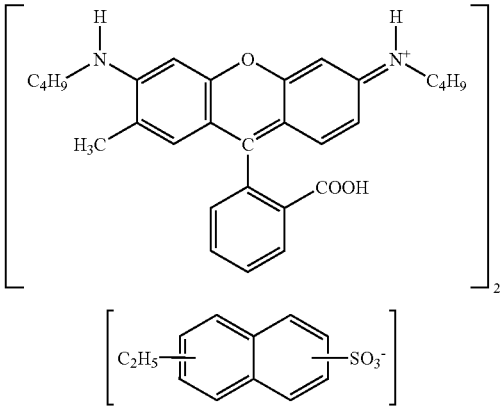

The coloring agent of the toner of the present invention may be employed in combination with other coloring agents such as a quinacridone pigment.

<Coloring Agent for Cyan Toner>

Coloring agents for a cyan toner include phthalocyanine based dyes represented by Formula (5).

Formula (5)

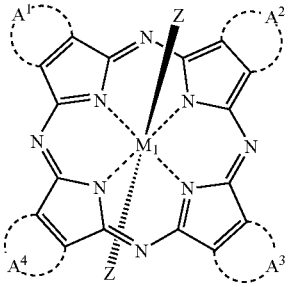

In Formula (5), $M_1$ represents any one of silicon atom, germanium atom, tin atom; Z represents a hydroxyl group, a chlorine atom, an aryloxy group of 6 to 18 carbon atoms, an alkoxyl group of 1 to 22 carbon atoms or a group represented by Formula (6). $A^1$, $A^2$, $A^3$ and $A^4$ each independently represents a methyl group or an atomic group which forms an aromatic group having electron controllable group; and Formula (6)

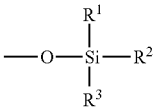

In Formula (6), $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms. $R^1$, $R^2$ and $R^3$ each may be the same or different.

Specific compounds represented by Formula (5) are listed in Table 1. The compounds represented by Formula (5) which may be employed in the present Application are not particularly limited to them.

TABLE 1

| Compound No. | $M_1$ | Aromatic ring ($A^1, A^2, A^3, A^4$) | Y | Substituent on aromatic rings |
|---|---|---|---|---|
| I-1 | Si | Benzen ring | —O—$Si(CH_2CH_3)_3$ | |
| I-2 | Si | Benzen ring | —O—$Si(CH_3)_3$ | |
| I-3 | Si | Benzen ring | —O—$Si(CH_2CH_2CH_3)_3$ | |
| I-4 | Si | Benzen ring | —O—$Si(CH_2CH_2CH_2CH_2CH_2CH_2CH_2CH_3)_3$ | |
| I-5 | Si | Benzen ring | —O—$Si(CH_2CH_2CH_2CH_2CH_2CH_2CH_2CH_3)(CH_3)_2$ | |
| I-6 | Si | Benzen ring | —O—$Si(t\text{-}C_4H_9)_3$ | |
| I-7 | Si | Benzen ring | —O—$Si(CH_2CH_3)_3$ | Monochloro atom |
| I-8 | Si | Benzen ring | —O—$Si(CH_2CH_3)_3$ | Dichloro atom |
| I-9 | Si | Benzen ring | —O—$Si(CH_2CH_3)_3$ | Trifluoromethyl group |
| I-13 | Sn | Benzen ring | —O—$Si(CH_2CH_3)_3$ | |
| I-14 | Ge | Benzen ring | —O—$Si(CH_2CH_3)_3$ | |
| I-15 | V | Benzen ring | —O—$Si(CH_2CH_3)_3$ | |
| I-16 | Si | Benzen ring | —O—$Si(CH_2CH_3)_3$ | |
| I-17 | Si | Benzen ring | —O—$Si(CH_2CH_3)_3$ | |
| I-18 | Ge | Benzen ring | —O—$Si(t\text{-}C_4H_9)_3$ | |
| I-20 | Sn | Benzen ring | O—$Si(CH_2CH_2CH_3)_3$ | |

The chemical structures of I-7, I-8 and I-9 are as follows.

I-7

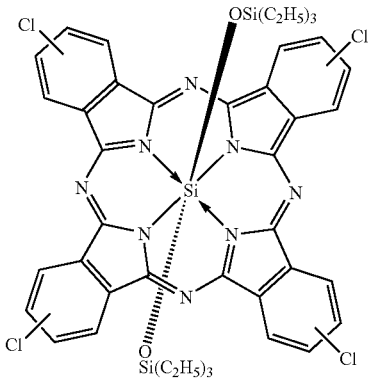

I-8

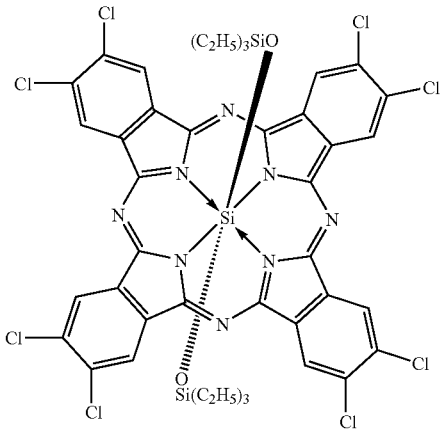

-continued

I-9

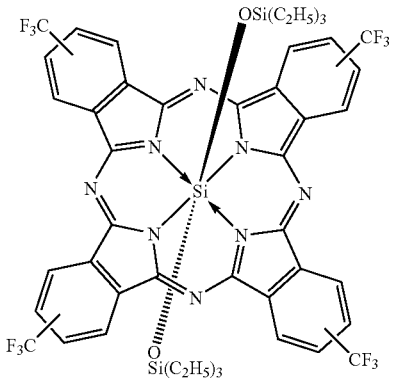

<Coloring Agent for Black Toner>

Coloring agents for a black toner include carbon blacks such as furnace black, channel black, acetylene black, thermal black and lump black; magnetic powder such as magnetite and ferrite.

The physical properties of the toner according to the present invention will be described.

The toner particles in the toner of the present invention preferably have a volume based median diameter ($D50_v$) from 3 to 8 μm.

By controlling the volume based median diameter of the toner particles within the range as mentioned above, the toner composed of a colorant of the present invention will be provided with a possibility to produce a larger range of color reproduction.

The volume based median diameter ($D50_v$) of the toner particles of the present invention can be measured and determined employing a size distribution measurement instrument, "COULTER MULTISIZER 3" (produced by Beckman-Coulter Co.) connected with a computer system (produced by Beckman-Coulter Co.) for data processing.

Measurement procedures are as follows. After allowing to soak 0.02 g of toner with 20 ml of a surface active agent solution (for example, a surface active agent solution, aimed at dispersing the toner), which is prepared by diluting a neutral detergent incorporating surface active agent components by a factor of 10), the mixture is subjected to microwave dispersion for one minute, whereby a toner dispersion is prepared.

The resulting toner dispersion is injected into a beaker carrying ISOTON II (produced by Beckman-Coulter Co.) in the sample stand until reaching a measurement concentration of 8% by weight. By controlling the concentration to this range, a high reproducible measurement value can be obtained. And measurement is carried out while setting the count of the instrument at 2,500 and the employed aperture diameter of 50 μm. The measuring range of 1 to 30 μm is divided into 256 sections and a frequency value in each section is calculated. The volume based median diameter is a particle diameter at which 50% of a volume ratio is achieved when each volume is integrated from a large sized particle to a small sized particle.

A diameter of the toner particles by Emulsion Coalescing Method may be measured by diluting the coalesced liquid. The median diameter ($D_{50}$) in the volume based particle distribution by this method is within a range of ±5% to the median diameter ($D_{50}$) obtained by the above method.

(Coefficient of Variation)

The toner particles in the toner of the present invention preferably have a coefficient of variation (CV value) of a volume based particle diameter distribution in the range of 2% to 21%, and more preferably from 5% to 15%.

A coefficient of variation (CV value) of a volume based particle diameter distribution indicates a degree of distribution of a volume based toner particles size and calculated by the following Equation (1).

When the CV value is small, it means that the particle diameter distribution is narrow, hence, the size of the toner particles is uniform.

CV value (%) of a volume based particle diameter distribution=((standard deviation in the volume based particle distribution)/(median diameter ($D50_v$) in the volume based particle distribution))×100. Equation (1)

(Softening Point)

The toner particles in the toner of the present invention have preferably a softening point ($T_{sp}$) of from 70 to 130° C., and more preferably from 70 to 120° C.

By setting the softening point to be within the above-described range, deterioration which may be induced by the heat applied during fixing can be decreased. As a consequence, an image can be formed without imposing undue thermal stress to the components of the aforementioned colorant. As a result, a vivid color image having a wide and stable color reproduction property can be reliably produced.

Further, due to the fact that a vivid color image having a wide and stable color reproduction property can be produced by setting the fixing temperature lower than conventional fixing temperature, electric power consumption required for image will be decreased and reduced environmental load can be achieved.

The softening point of a toner can be controlled by the following methods, singly or in combination:

(1) the kind or the composition of monomer used for resin formation is adjusted;

(2) the molecular weight of a resin is controlled by the kind or the amount of a chain-transfer agent; and (3) the kind or amount of a wax is controlled.

The softening point can be controlled by appropriately combining the methods (1) to (3).

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a long nozzle having a diamante 1 mm and a length 1 mm, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

(Average Circularity of Toner Particles)

The toner of the present invention contains preferably toner particles having an average circularity defined by the following Equation (3) of 0.920 to 1.000, and more preferably, of 0.930 to 0.980 from the viewpoint of increasing transferring efficiency.

Average circularity=(circumferential length of a circle having the same projective area as that of a particle image)/(circumferential length of the projective particle image) Equation (3)

Next, methods to manufacture the toner of the present invention will be described.

(Manufacturing Method of Toner)

The methods are not particularly limited and listed may be a pulverization method, a suspension polymerization method, a mini-emulsion polymerization aggregation method, an emulsion polymerization aggregation method, a dissolution suspension method, and a polyester molecule elongation method, as well as other conventional methods. Of these, it is preferable to prepare the toner via the mini-emulsion polymerization aggregation method.

In a mini-emulsion polymerization aggregation method, a polymerizable monomer solution in which waxes are dissolved is placed into an aqueous medium in which surface active agents are dissolved to reach at most the critical micelle concentration, and by utilizing mechanical energy, a dispersion, in which 10-1,000 nm oil droplets are formed, is prepared. Water-soluble radical polymerization initiators are added to the resulting dispersion followed by polymerization, whereby binder resin particles are formed. Further, by aggregating binder resin particles while fusing particles, toner particles are prepared.

Reasons why the mini-emulsion polymerization aggregation method is preferred are that since polymerization is carried out within each oil droplet, it is possible to form a state in which wax particles are assuredly included via the binder resins within the toner particle, and as a result, vaporization components are not generated until heating via a fixing apparatus, and wax performance is not deteriorated, whereby targeted aims are assuredly achieved.

In addition, in the mini-emulsion polymerization aggregation method, instead of the addition of the aforesaid water-soluble radical polymerization initiators, or together with the water-soluble radical polymerization initiators, it is also possible to achieve polymerization by adding oil-soluble radical polymerization initiators into the aforesaid monomer solution.

As the toner preparation method, according to the present invention, during formation of resin particles via the mini-emulsion polymerization aggregation method, it is possible to form resin particles having a structure of at least two layers composed of binder resins which differ in composition. In this case, polymerization initiators and polymerizable monomers are added to the first resin particle dispersion which is prepared via a conventional mini-emulsion polymerization process (being a first step polymerization), and the resulting system then undergoes polymerization (being the second step polymerization).

One example of a method for producing a toner employing the mini-emulsion polymerization aggregation method will now be specifically described. The method includes the following procedures.

(1) a dissolving and dispersing process which prepares a polymerizable monomer solution by dissolving or dispersing, toner particle constituting materials such as a wax and a charge controlling agent according to need, in a polymerizable monomer used for a binding resin;

(2) a dispersed solution preparation process in which the specific colorant of the present invention is dispersed in an aqueous media to obtain a colorant particle dispersion solution.

(3) a polymerization process in which oil droplets of the aforesaid polymerizable monomer solution are formed in an aqueous medium and then a binder resin particle dispersion is prepared using a mini-emulsion method;

(4) an aggregating and fusing process in which aggregated particles are formed from the aforesaid binder resin particles, colorant particles via aggregation, and fusion in an aqueous medium;

(5) a ripening process in which a dispersion of the colored particles is prepared by ripening aggregated particle via thermal energy to regulate their shape;

(6) a cooling process in which the dispersion of colored particles are cooled;

(7) a filtering and washing process in which the aforesaid colored particles are subjected to solid-liquid separation from the cooled colored particle dispersion, and surface active agents and the like are removed from the aforesaid colored particles; and (8) a drying process which dries the colored particles which have been washed (9) an external additive treatment process in which an external additive is added to the dried toner particles.

Each of the above processes will now be described below (1) Dissolving/Dispersion Process This process is a process to dissolve or disperse toner particle constituting materials such as a wax and colorants in a polymerizable monomer to prepare a polymerizable monomer solution.

An amount of the wax is set so as to have the content of the wax in the toner to be in the afore-mentioned range.

An oil-soluble polymerization initiator and/or other oil-soluble components may be added to the polymerizable monomer solution.

(2) Dispersion Preparation Process

This dispersion preparation process is one in which the aforesaid specific colorant of the present invention are dispersed into a respective aqueous medium, and each of the metal compound dispersion, the dye particle dispersion, and the colorant particle dispersion is prepared.

It is possible to prepare these colorant particle dispersions by dispersing colorants into an aqueous medium. The dispersion process of colorant particles is carried out in such a state that the concentration of surface active agents exceeds the critical micelle concentration (CMC) in water. Homogenizers employed for the dispersion process of colorant particles are not particularly limited and preferably employed are ultrasonic homogenizers, mechanical homogenizers, and pressure homogenizers such as a Manton-Gaulin homogenizer or pressure system homogenizer, as well as medium type homogenizers such as a sand grinder, a Getzmann mill, or a diamond fine mill.

It is possible to employ colorant particles which have undergone surface property modification. In practice, colorant particles are dispersed into solvents and surface property modifying agents are then added to the above dispersion. Subsequently, by increasing the temperature of the above system, the targeted reaction is carried out. After completion of the reaction, the colorant particles are collected via filtration. After repeated washing with the same solvents, drying is carried out, whereby it is possible to prepare minute colorant particles which have been treated with the surface property modifying agents.

(3) Polymerization Process

The above process is one to form binder resin particles incorporating waxes and binder resins. In the polymerization process, for example, the aforesaid polymerizable monomer solution is added to an aqueous medium incorporating surface active agents at a concentration of, at most, the critical micelle concentration, and oil droplets are formed via application of mechanical energy. Subsequently, by adding water-soluble radical polymerization initiators, a polymerization reaction is carried out in the aforesaid oil droplet. Further, when multilayer structure resin particles are formed, resin particles, which are employed as a nucleus particle in the aqueous medium, may be added.

The binder resin particles formed in the polymerization process may be or may be not colored. Colored binder resin particles are formed by polymerizing a monomer composition incorporating colorants. Further, when the binder resin particles, which are not colored, are formed, a colorant particle dispersion is added into the binder resin particle dispersion during the aggregation process, described below, followed by aggregation of the binder resin particles with the colorant particles, whereby it is possible to form toner particles.

"Aqueous medium", as described herein, refers to a medium which is composed of water as a major component (at least 50% by weight). Examples of water-soluble organic solvents, which are components other than water, include methanol, ethanol, isopropanol, butanol, acetone, methyl ethyl ketone, and tetrahydrofuran. Of these, specifically preferred are alcohol based organic solvents such as methanol, ethanol, isopropanol, and butanol, which do not dissolve the resins.

Further, methods to disperse a polymerizable monomer solution into an aqueous medium are not particularly limited, but a method is preferred in which dispersion is carried out via application of mechanical energy. Homogenizers in which oil droplet dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably 10-1,000 nm, but is more preferably 30-300 nm.

(4) Aggregation and Fusion Process

An aggregation and fusion process is one in which the binder resin particles, formed via the aforesaid polymerization process, are aggregated and fused in an aqueous medium. During the aggregation and fusion process, if the aforesaid binder resin particles are not colored, a colorant particle dispersion is added into the binder resin particle dispersion, followed by aggregation and fusion of the binder resin particles and the colorant particles. During the intermediate step of the above aggregation and fusion process, it is possible to carry out aggregation by the addition of binder resin particles which differ in the resin composition.

Further, in the aforesaid aggregation and fusion process, it is possible to carry out aggregation and fusion by the addition of internal additive particles such as charge control agents together with binder resin particles and colorant particles.

A preferred aggregation and fusion method is that aggregating agents composed of alkaline metal salts and alkaline earth metal salts are added, in an amount to reach at least the critical aggregation concentration, to an aqueous medium in which binder resin particles and colorant particles exist, whereby these particles are aggregated. Subsequently, heating is carried out to at least the glass transition temperature of the binder resin particles, as well as to at least the melt peak temperature of wax, whereby aggregation and fusion are simultaneously carried out.

During the above aggregation and fusion process, it is required to quickly increase the temperature by heating, and the temperature increasing rate is preferably at least 1° C./minute. The upper limit of the temperature increasing rate is not particularly limited. However, since coarse particles are generated via the progress of quick aggregation and fusion, to retard the above, at most 15° C./minute is preferred.

Further, it is critical that after the temperature of the binder resin particle and colorant particle dispersion reaches at most the glass transition and also at most the melt peak temperature of wax, coagulation and fusion are allowed to continue by maintaining the temperature of the aforesaid dispersion for a predetermined duration. As noted above, by maintaining the temperature of the dispersion for the predetermined duration, growth (coagulation of binder resin particles and colorant particles) of toner particles and fusion (elimination of the interface between the particles) are effectively carried out, whereby it is possible to enhance endurance of the finally prepared toner.

(5) Ripening Process

In the above ripening process, it is preferable to carry out shape control of toner particles via thermal energy (heating).

The above ripening process is one in which, in practice, a system incorporating aggregated particles is stirred while heated, and the shape of aggregated particles is regulated by controlling the heating temperature, the stirring rate, and the heating temperature to reach the targeted average circularity, whereby toner particles having the targeted shape are prepared.

Further, during the aforesaid ripening process, a binder resin particle dispersion is further added to the aforesaid toner particle dispersion so that the binder resin particles are adhered onto the surface of the toner particle to result in fusion and toner particles designated, as a so-called core-shell structure, may be formed. In this case, it is preferable that the glass transition point temperature of the binder resin particles forming the shell is regulated to be 20° C. higher than that of the binder resin particles which constitute the core.

Further, when binder resin particles employed in the aforesaid aggregation and fusion process are composed of resins (hydrophilic resins) which are prepared by employing, as a raw material, polymerizable monomers having an ionic dissociation group, described below, and resins (hydrophobic resins) which are prepared by employing, as a raw material, only polymerizable monomers having no ionic dissociation group, it is possible to form toner particles having the core-shell structure in such a manner that during the above ripening process, the hydrophilic resins are oriented on the surface side of the aggregated particle, while hydrophobic resins are oriented on the interior side of the aggregated particle.

(6) Cooling Process

This process is a process of subjecting the dispersion of the toner particles to the cooling treatment. The condition of the cooling treatment is to cool is preferably at a cooling rate of 1-20° C./min. The method of the cooling treatment, although it is not specifically limited, may include a method of cooling by introducing a cooling medium from outside of a reaction container and a method of cooling by directly charging cool water into the reaction system.

(7) Solid-Liquid Separation and Cleaning Process

In the solid-liquid separation and cleaning process, the following treatments are applied: a solid-liquid separation treatment of subjecting the toner particles to solid-liquid separation from the dispersion of the toner particles having been cooled down to a predetermined temperature in the above process; and a cleaning treatment of removing deposits such as the surfactant and the salting-out agent from a toner cake (an aggregation substance with a cake-shape) having been subjected to solid-liquid separation.

In the cleaning treatment, the washing with water is repeated to and checked the electric conductivity of the filtrated water to become 10 μS/cm. In the solid-liquid separation treatment, the known methods such as the centrifugal separation method, vacuum filtration method using Nutsche, and the filter method using a filter press are employed.

(8) Drying Process

This process is a process of subjecting the toner cake having been subjected to the cleaning treatment to the dry treatment to obtain dried colored particles. Listed as the dryer used in this process may be, for example, a spray dryer, a vacuum-freeze dryer, and a decompression dryer, and it may be used a stationary rack-dryer, a movable rack-dryer, a fluidized dryer, a rolling dryer, an agitation dryer and other dryers. The water content of the dried colored particle is preferably 5% by weight or less, more preferably 2% by weight or less. Incidentally, when the toner particles having been subjected to the dry treatment are agglomerated with a weak intermolecular force among the particles, the agglomeration may be subjected to a powder treatment. Herein, mechanical type of powder machines such as a jet-mill, HENSCHEL MIXER, a coffee mill, a food processor may be used as the powder treatment machine.

(9) External Additive Treatment Process

This process is a process of manufacturing the toner by mixing an external additive in the dried toner particles according to the necessity. As the mixer for the external additive, mechanical type of mixers such as a HENSCHEL MIXER and a coffee mill may be used.

Specific components comprising toner employed in the present invention will be described.

When a toner employed in the present invention is produced by a pulverization method or by a dissolution suspension method, several well-known binders as a component of binder resin of toner include a vinyl based resin such as stylene resin, (meth)acrylate resin, stylene-(meth)acrylate copolymer resin, olefin based resin, polyester resin, polyamide resin, carbonate resin, polyether, polyvinylacetate resin, polysulfone, epoxy resin, polyurethane resin and urea resin. These resins can be used in ether alone or in combination of at least two thereof.

When a toner employed in the present invention is produced by a suspension polymerization method, a mini-emulsion polymerization aggregation method, an emulsion polymerization aggregation method, specific examples of a polymerizable vinyl monomer are below:

(1) styrene or styrene derivatives:

styrene, o-methylstyrene, m-methyl styrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) methacrylic acid ester derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) acrylic acid ester derivatives:

methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate, (4) olefins:

ethylene, propylene and isobutylene;

(5) halogenated vinyl compounds;

Vinyl chloride, vinylidene chloride, vinyl bromide, vinyl fluoride and vinyliden fluoride;

(6) vinyl esters:

vinyl propionate, vinyl acetate and vinyl benzoate;

(7) vinyl ethers:

vinyl methyl ether and vinyl ethyl ether;

(8) vinyl ketones:

vinyl methyl ketone, vinyl ethyl ketone and vinyl hexyl ketone;

(9) N-vinyl compounds:

N-vinyl carbazole, N-vinyl indole and N-vinyl pyrrolidone;

(10) others:

vinyl compounds such as vinylnaphthalene and vinylpyridine; acrylic acid or methacrylic acid derivatives such as acrylonitrile, methacrylonitrile and acrylamide.

These vinyl monomers can be used in ether alone or in combination of at least two thereof.

There may also usable polymerizable monomers containing ionic-dissociative group, as a vinyl monomer, and including, for example, those having a side chain containing a functional group such as a carboxyl group, a sulfonic acid group or a phosphoric acid group. Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido -2-methylpropanesulfonic acid; and phosphoric acid group containing monomers such as acid phosphooxyethyl methacrylate.

Further, a cross-linked resin can be obtained using polyfunctional vinyl compounds. Examples of such poly-functional vinyl compounds are shown below.

Examples of a poly-functional vinyl compound include: divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

(Surface Active Agents)

When the toner according to the present invention is produced via a suspension polymerization method, the aforesaid mini-emulsion polymerization aggregation method, or an emulsion polymerization aggregation method, surface active agents are added into an aqueous medium, whereby binder resins and aggregated particles are prepared Surface active agents employed in these polymerization methods are not particularly limited, but the ionic surface active agents listed below are preferred:

(1) sulfonic acid salts; sodium dodecylbenznesulfonate and sodium arylalkylpolyether sulfonate (2) sulfuric acid ester salts; sodium dodecylsulfate, sodium tetradecylsulfate, sodium pentadecylsulfate, and sodium octylsulfate (3) fatty acid salts; sodium oleate, sodium laurate, sodium caprate, sodium caprylate, sodium caproate, potassium stearate, and calcium oleate.

Further, it is also possible to employ the nonionic surface active agents listed below: namely, polyethylene oxides, polypropylene oxides, combinations of polypropylene oxides and polyethylene oxides, esters of polyethylene glycol with higher fatty acids, alkylphenol polyethylene oxides, esters of higher fatty acid and polyethylene glycol, esters of higher fatty acid and polypropylene oxides, and sorbitan esters. These surface active agents are used as an emulsifier when the toner is produced via an emulsion polymerization aggregation method. They may also be used in other process and for other purpose.

(Polymerization Initiators)

When the toner according to the present invention is produced via a suspension polymerization method, the aforesaid mini-emulsion polymerization aggregation method, or an emulsion aggregation method, it is possible to form binder resins by polymerizing polymerizable monomers while employing radical polymerization initiators.

When resins are formed via the suspension polymerization method, oil-soluble radical polymerization initiators are employable. Specific examples of the oil-soluble polymerization initiators include:

(1) azo based or diazo based polymerization initiators; 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile (2) peroxide based polymerization initiators; benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine, and (3) polymer polymerization initiators having a peroxide on the side chain Further, when binder resins are formed via the mini-emulsion polymerization aggregation method or the emulsion polymerization aggregation method, water-soluble radical polymerization initiators are employable. Examples of water-soluble radical polymerization initiators include persulfate salts such as potassium persulfate or ammonium persulfate, azobisaminodipropane acetic acid salts, azobiscyanovaleric acid and salts thereof, and hydrogen peroxide.

(Chain Transfer Agents)

When the toner according to the present invention is produced via a suspension polymerization method, the aforesaid mini-emulsion polymerization aggregation method, or an emulsion polymerization aggregation method, to regulate the molecular weight of binder resins, prior art chain transfer agents are employable.

Specific chain transfer agents include mercaptans such as n-octylmercaptan, n-decylmercaptan, or tert-dodecylmercaptan, as well as n-octyl-3-mercaptopropionic acid esters, terpinolene, carbon tetrabromide, and $\alpha$-methylstyrene dimers.

(Aggregating Agents)

When the toner according to the present invention is produced via a mini-emulsion polymerization aggregation method or an emulsion polymerization aggregation method, in order to aggregate resin particles, aggregating agents are employed. Examples of aggregating agents include alkaline metals and alkaline earth metals. Alkaline metals to constitute aggregating agents include lithium, potassium, and sodium, while alkaline earth metals to constitute aggregating agents include magnesium, calcium, strontium, and barium. Of these, preferred are potassium, sodium, magnesium, calcium, and barium. As a counter ion (being an anion to constitute a salt) of the aforesaid alkaline metals or alkaline earth metals, listed are a chloride ion, a bromide ion, an iodide ion, a carbonate ion, and a sulfate ion.

(Colorants)

By a method of the present invention for forming a full color image, a yellow toner, a magenta toner, a cyan toner and a black toner can be used in combination. Inorganic or organic colorants known in the art can be used as a colorant for producing a color toner other than a color toner which uses aforesaid specific colorants.

Aforesaid specific colorants can be used alone or in combination for colorants for each color.

The content of colorant is preferably 1% to 30% by mass based on total amount of toner, more preferably 2% to 20% by mass A surface modified colorant can be used as a colorant. Surface modifiers known in the art can be used for a surface modifier for this purpose. Examples of a surface modifier listed below are preferred: silane coupling agent, titanium coupling agent and aluminum coupling agent.

(Releasing Agents)

The toner of the present invention may contain a wax with a resin and the aforementioned dye. Examples of a wax include:

(1) polyolefin wax such as polyethylene wax and polypropylene wax;
(2) long chain hydrocarbon wax such as paraffin wax and sasol wax and microcrystalline wax;
(3) dialkyl ketone type wax such as distearyl ketone;
(4) ester type wax such as carnauba wax, montan wax, trimethylolpropane tribehenate, pentaerythritol tetramyristate, pentaerythritol tetrabehenate, pentaerythritol diacetate dibehenate, behenyl behanate, glycerin tribehenate, 1,18-octadecanediol distearate, trimellitic acid tristearate, and distearyl meleate; and
(5) amide type wax such as ethylenediamine dibehenylamide and trimellitic acid tristearylamide.

Among the above-described waxes, preferable waxes are microcrystalline wax and behenyl behanate, and the combination of these two waxes.

The melting point of a wax usable in the invention is preferably 40 to 125° C., more preferably 50 to 120° C., and still more preferably 60 to 90° C.

By using a wax having a melting point falling within the foregoing range, heat stability of toners can be ensured. And stable toner image formation can be achieved without causing cold offsetting even when the image is fixed at a relatively low temperature.

The wax content of the toner is preferably in the range of 1% to 30% by mass, and more preferably 5% to 20%. When the added amount of the wax becomes lower than the above-described range, undisturbed separation property of the paper in fixing step may occur, and when the added amount of the wax exceeds the above-described range, the transparency of the toner image way be decreased.

(Charge Controlling)

Further, a well-known charge controlling agent can also be added to the toner of the present invention. A charge controlling agent is not particularly limited. A colorless, white, or light colored charge controlling agent which does not have an adverse effect on the color tone of a toner and on light transmittance can be used as a negative charge controlling agent. Examples of a negative charge controlling agent are as follows: a metal complex of a salicylic acid derivative; a calixarene compound; an organic boron compound; and a fluorine containing quaternary ammonium salt compound.

The above-mentioned salicylic acid metal complex which can be used in the present invention is disclosed, for example, in JP-A Nos. 53-127726 and 62-145255. As a calixarene compound which can be used is, for example, disclosed in JP-A No. 2-201378. As an organic boron compound which can be used is, for example, disclosed in JP-A Nos. 2-221967 and 3-1162. The amount of addition of these charge controlling agent is preferably 0.1 to 10 mass parts to 100 mass parts of a binder resin, and more preferably 0.5 to 5.0 mass parts.

An image stabilizer can also be added in order to raise a image lasting quality. Examples of an image stabilizer include: the compounds disclosed in JP-A No. 8-29934; and a phenol compound, an amine compound, a sulfur compound, a phosphor compound available in the market as an image stabilizer. In addition, an ultraviolet absorption agent can also be added for the same purpose, and a well-known organic ultraviolet absorption agent and an inorganic system ultraviolet absorption agent can be added.

Specific examples of an organic ultraviolet absorption agent are as follows, (1) Benzotriazole compound: 2-(2'-hydroxy-5'-t-butylphenyl)benzotriazole, 2-(2'-hydroxy-3', 5'-di-t-butylphenyl) benzotriazole;
(2) Benzophenone compound: 2-hydroxy-4-methoxybenzophenone and 2-hydroxy-4-n-octyloxybenzophenone;
(3) Phenyl salicylate compound: phenyl salicylate, 4-t-butylphenyl salicylate; and
(4) Hydroxybenzoate compound: 2,5-t-butyl-4-hydroxybenzoic acid n-hexadecyl ester, 2,4-di-t-butylphenyl-3', 5'-di-t-butyl -4'-hydroxybenzoate.

Specific examples of an inorganic ultraviolet absorption agent are as follows: titanium oxide, zinc oxide, cerium oxide, iron oxide and barium sulfate. Among an organic ultraviolet absorption agent and an inorganic ultraviolet absorption agent, an organic system absorption agent is more preferable.

Although the amount of addition of an ultraviolet absorption agent is not particularly limited, a preferably amount of addition is 10-200 mass % to coloring matter, and more preferably it is 50-150 mass %.

(External Additives)

Furthermore, from a viewpoint of giving fluidity of a toner, or improving cleaning property, the toner of the present invention can be added and mixed a well-known external additive in the toner. The kinds of these external additives is not particularly limited, and various inorganic particulates, organic particulates, and lubricants can be used.

Examples of inorganic particulates are: inorganic oxide particles such as silica, titania and alumina. These external additives may be subjected to a hydrophobic treatment using, for example, a silane coupling agent and a titanium coupling agent.

Spherical organic microparticles having a number-average primary particle size of 10 to 2000 nm are usable as organic microparticles. Specifically, there is usable styrene or methyl methacrylate homopolymer or their copolymers.

Such an external additive is incorporated preferably in an amount of 0.1 to 5.0 weight % based on the total weight of the toner, and more preferably in an amount of 0.5 to 4.0 weight %. Such an external additive may be added solely or in combination with two or more of other additives.

Next, the developing agents employed in the full-color image forming method of the present invention will be described.

<<Developing Agent>>

In the full-color image forming method of the present invention, images can be formed employing a magnetic or non-magnetic mono-component developing agent, or a two-component developing agent which is blended with carriers.

In case where the toner of the invention is employed as a two-component developing agent, commonly known materials are usable as a carrier. Examples thereof are metals such as iron, ferrite and magnetite, and alloys of the foregoing metals with metals such as aluminum and lead, of which ferrite particles are preferred. The carrier preferably exhibits a volume-average particle size of 15 to 100 μm, and more preferably 25 to 80 μm.

In case where the toner of the present invention is employed as a non-magnetic mono-component developing agent, the toner itself, which constitutes the aforesaid developing agent, is electrically charged by being rubbed or pressed onto a charging member or the surface of a developing roller, so that the structure of the developing apparatus can be simplified, and therefore, the whole image forming apparatus can be downsized. As a result, it becomes possible to form full-color images with excellent color reproduction even in working places with a limited space.

An image forming apparatus, which is used for forming a full color image according to the present invention, will now be described.

At first, an image forming apparatus, which is carried out employing the toner of the present invention as a two-component developer, will now be described.

FIG. 1 illustrates an example of an image forming apparatus in which the toner of the present invention is usable as a two-component developer.

In FIGS. 1, 1Y, 1M, 1C and 1K each designate photoreceptors; 4Y, 4M, 4C and 4K each designate a developing means; 5Y, 5M, 5C and 5K each designate primary transfer rollers; 5A designates a secondary transfer roller; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10K, an intermediate transfer material unit 7 including an endless belt form of a transfer belt, paper feeding and conveying means 22A to 22D to convey recording member P and heated roll-type fixing device 24. Original image reading device SC is disposed in the upper section of image forming apparatus body A.

Image forming section 10Y to form a yellow image contains a drum-form photoreceptor 1Y; electrostatic-charging means 2Y, exposure means 3Y and developing means 4Y which are disposed around the photoreceptor 1Y; primary transfer roller 5Y; and cleaning means 6Y.

Image forming section 10M to form a magenta image as another color contains a drum-form photoreceptor 1M; electrostatic-charging means 2M, exposure means 3M and developing means 4M which are disposed around the photoreceptor 1M; primary transfer roller 5M; and cleaning means 6M.

Image forming section 10C to form a cyan image as another color contains a drum-form photoreceptor 1C; electrostatic-charging means 2Y, exposure means 3C and developing means 4C which are disposed around the photoreceptor 1C; primary transfer roller 5C; and cleaning means 6C. Further, there are provided an image forming section 10K to form a black image containing a drum-form photoreceptor 1K; electrostatic-charging means 2K, exposure means 3K and developing means 4K which are disposed around the photoreceptor 1K; primary transfer roller 5K; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray 26 outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Housing 8 is composed of image forming parts 10Y, 10M, 10C, and 10K, as well as endless belt type intermediate transfer body unit 7.

Image forming parts 10Y, 10M, 10C, and 10K are provided in a tandem arrangement in a vertical direction. Endless belt type intermediate transfer body unit 7 is provided at the left side of photoreceptors 1Y, 1M, 1C, and 1K in the illustration Endless belt type intermediate transfer body unit 7 is composed of rotatable endless belt type intermediate transfer body 70 which rotates around rolls 71, 72, 73, 74, and 76, primary transfer rolls 5Y, 5M, 5C, and 5K, and cleaning means 6A.

By an operation of pulling out of housing 8, image forming parts 10Y, 10M, 10C, and 10K, and endless belt type intermediate transfer body unit 7 can be pulled out as an integrated unit from the main body.

In such a way, toner images are each formed on photoreceptors 1Y, 1M, 1C, and 1K through steps of charging, exposing, and developing; then, toner images of each color are superposed on endless belt type intermediate transfer body 70, which are then transferred, as an integrated image, onto recording member P; and then the resulting image is fixed by pressing and heating by fixing device 24. Photoreceptors 1Y, 1M, 1C, and 1K, after each toner image thereon is transferred to recording member P, get into the above cycle of charging, exposing, and developing, after residual toners left on the photoreceptors during transfer step are cleaned by cleaning means 6A, and then, the next image formation is carried out.

Next, the image forming apparatus, in which the toner of the present invention is employed as a mono-component developing agent, will be described.

Figure 2:
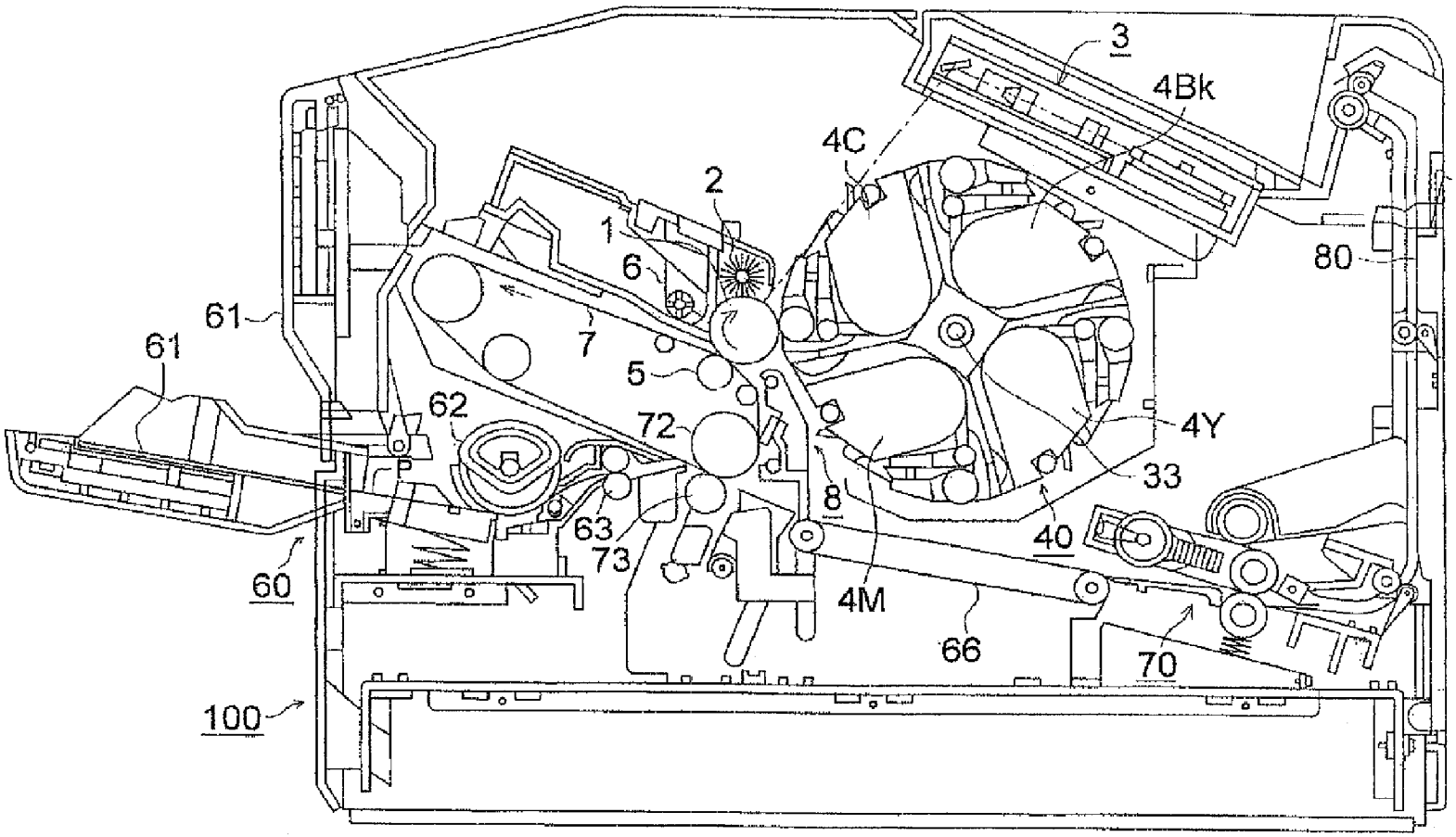
FIG. 2: A schematic view showing an example of an image forming apparatus employing the toner of the present invention as a mono-component developing system

FIG. 2 is a schematic view showing an example of an image forming apparatus employing the toner of the present invention as a mono-component developing system.

Image forming apparatus 100 shown in FIG. 2 is a typical image forming apparatus which can be installed with above developing device 40. In the image forming apparatus of FIG. 2, around rotary-drivable electrostatic latent image bearing body 1 (hereinafter also referred to as photoreceptor drum), electrostatic-charging brush 2 to allow the surface of photoreceptor drum 1 to be uniformly charged to a prescribed potential, and cleaner 6 to remove residual toners on photoreceptor drum 1 are provided.

Laser scanning optical system 3 scanning-exposes the surface of photoreceptor drum 11 which was uniformly charged by charging brush 2 to form an electrostatic latent image on photoreceptor drum 1. Laser scanning optical system 3 houses a laser diode, a polygon mirror, and an fθ optical system, and in the control section, print data for each of yellow, magenta, cyan and black are transferred from a host computer. Then, based on the print data for the respective colors, laser beams are successively outputted to scanning-expose the surface of photoreceptor drum 1 to form an electrostatic latent image of each color.

Development device unit 40, which houses development devices 4Y, 4M, 4C and 4BK feeds the individual color toners onto photoreceptor drum 1 on which an electrostatic latent image is formed to perform development. Development device unit 40 is provided, around shaft 33, with four development devices 4Y, 4M, 4C and 4Bk which house non-magnetic mono-component yellow, magenta, cyan and black toners, respectively, whereby the above unit is rotated centering around shaft 33 so that each individual development device 4Y, 4M, 4C and 4BK is brought to the position opposite to photoreceptor drum 1.

Development device unit 40 rotates on center shaft 33 every time an electrostatic latent image of each color is formed on photoreceptor drum 1 by laser scanning optical system 3, and guides development devices 4Y, 4M, 4C and 4BK which houses a corresponding color toner, to the position opposite to photoreceptor drum 1. Thereby, the respective charged color toners are successively supplied from each of development devices 4Y, 4M, 4C, and 4BK onto photoreceptor drum 1 to perform development.

In the image forming apparatus shown in FIG. 2, endless intermediate belt 7 is provided downstream side in the rotation direction of photoreceptor drum 1 from development device unit 40, and the belt is rotated in synchronization with photoreceptor drum 1. Intermediate transfer belt 7 contacts photoreceptor drum 1 at the site being pressed by primary transfer roller 5, whereby the toner image formed on photoreceptor drum 1 is transferred onto intermediate transfer belt 7. Further, secondary rotating transfer roller 73 is provided, in a rotatable manner, opposing to support roller 72 which supports intermediate transfer belt 7, and the toner image carried on intermediate transfer belt 7 is transferred onto recording material P such as a recording paper sheet by being pressed at a point where support roller 72 and secondary roller 73 are facing each other.

Between full-color developing device unit 40 and intermediate transfer belt 7, cleaner 8 to remove any residual toner on intermediate transfer belt 7 is provided with being detachable from intermediate transfer belt 7.

Paper feeding means 60, which guides recording material P onto intermediate transfer belt 7, is constituted of paper-feeding tray 61 housing recording material P, paper-feeding roller 62 to feed individual sheets of recording material P housed in paper-feeding tray 61, and timing roller 63 to transfer fed recording material P to the secondary transfer site.

Recording material P, onto which a toner image has been transferred by being pressed, is conveyed to fixing device 24 via conveyance means 66 constituted of members such as an air-suction belt, after which the transferred toner image is fixed on recording material P by fixing device 24. After fixing, recording material P is conveyed through vertical conveyance path 80, and discharged onto the upper surface of apparatus body 100.

Figure 3:
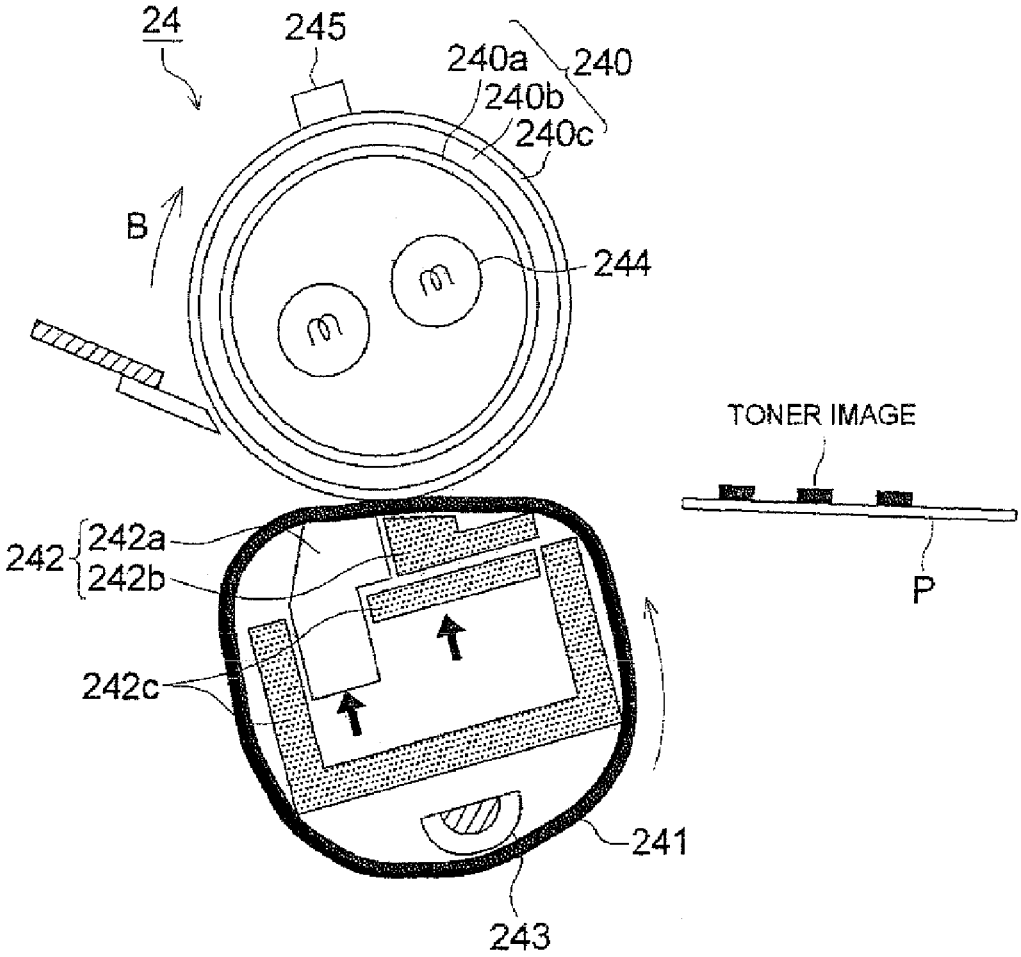
FIG. 3: A schematic view showing an example of a fixing device of a belt fixing system employing a belt and a heat roller

FIG. 3 is a schematic view showing an example of the fixing device (a type using a belt and a heat roller).

The fixing device 24 shown in FIG. 3 is a type using a belt and the heat roller for keeping the nip width, wherein the key section contains a heat roller 240 and a seamless belt 241, a pressure pads (pressure members) 242*a*, 242*b* which are pressed against the heat roller 240 via the seamless belt 241, and a lubricant supplying member 243. B represents the rotation direction of the heat roller 240.

The heat roller 240 contains a heat resistant elastic body layer 240*b* and a releasing layer (heat resistant resin layer) 240*c* which are formed around a metal core (cylindrical cored bar) 240*a*, wherein inside the core 240*a* is provided with the halogen lamp 244 as the heat source. The temperature of a surface of the heat roller 240 is measured with the temperature sensor 245, and the halogen lamp is feedback-controlled by a temperature controller not shown in response to the measured signal, whereby the surface of the heat roller 240 is controlled so that the temperature thereof is constant. The seamless belt 241 is contacted as to be wound by a predetermined angle relative to the heat roller 240 to form a nip section.

Inside the seamless belt 241 is provided with a pressure pad 242 having a low friction layer on a surface thereof in the state of being pressed against the heat roller 240 via the seamless belt 241. The pressure pad 242 contains the pressure pad 242*a* to which a strong nip pressure is applied and the pressure pad 242*b* to which a weak nip pressure is applied, the pressure pads 242*a*, 242*b* being held by a holder 242*c* made of metal or other materials.

The holder 242*c* is further mounted with a belt-travel guide so that the seamless belt 241 can slide and rotate smoothly. Because the belt-travel guide chafes against an inner surface of the seamless belt 241, a member for the belt-travel guide is desired to have a lower friction coefficient and also has a low heat conduction in order not to take the heat away from the seamless belt 241. As a specific example of the material of the seamless belt 241, polyimide is preferably used.

Image formation is achieved in such a manner that the toner image formed by toners of the present invention is finally transferred onto transfer material P, and then, the image is fixed on the transfer material via a fixing treatment. Transfer material P employed in the above image formation is a support bearing a toner image, and is usually called an image support, a recording material, or a transfer paper sheet. Specific examples of the transfer materials include, but not limited to, a plain paper sheet or a high-quality paper sheet of various thickness from a thin paper sheet to a thick paper sheet, a coated printing paper sheet such as an art paper sheet and a coated paper sheet, a commercial Japanese paper sheet or a postcard, a plastic sheet for OHP use or cloth.

EXAMPLES

The embodiments of the present invention will be described, but the invention is by no means limited to these.

<<production of Cyan Toner>>

The toner was produced by a method described below.

<Production of Cyan Toner 1>: (Production of Toner by Pulverizing Method)

(Mixing Step)

100 parts by mass of a polyester resin (a condensation product of bisphenol A-ethylene oxide adduct with terephthalic acid and trimellitic acid; exhibiting a weight-average molecular weight of 20,000), 7.0 parts by mass of microcrystalline wax HNP-0190 (produced by Nippon Seiro Co., Ltd), and one part by mass of charge control agent composed of boron dibenzilic acid were charged into a Henschel mixer (manufactured by Mitsui Miike Machinery Co., Ltd.), and was subjected to a blending treatment over 5 minutes at a circumferential rate of the mixing blades being set to 25 m/second. Cooling water of 9° C. was circulated in a jacket of the Henschel mixer to cool down the mixture so that the temperature thereof became below 25° C.

Subsequently, 5.5 parts by mass of a coloring agent "phthalocyanine (I-1 compound)" was charged into the above Henschel mixer, and was subjected to a blending treatment over 30 minutes at a circumferential rate of the mixing blades being set to 40 m/second. During the blending treatment, warm water of 40° C. was circulated in a jacket of the Henschel mixer. The temperature of the mixture, while blending, was 47° C.

(Kneading Step)

The resulting mixture was kneaded with heating at 140° C. via a biaxial extrusion kneading machine. The temperature of the kneaded mixture at the discharge section of the kneading machine was 145° C. After that, the kneaded mixture was let stand to cool over 6 hours.

(Pulverization and Classification Steps)

At a time when the temperature of the kneaded mixture reached 28° C., the kneaded mixture was pulverized via a turbo-mill pulverizer (manufactured by Turbo Kyogyo Co., Ltd.) after initially being coarsely pulverized by a hammer mill. After that, the resulting fine particles were subjected to a classification treatment via an air classifying machine to produce toner particles with a volume-based median size ($D_{50}$) of 5.4 μm (Step of External Additive Treatment)

To toner particles thus obtained were added 0.6 parts by mass of hexamethylsilazane treated silica (an average primary particle size of 12 nm) and 0.8 parts by mass of n-octylsilane treated titanium oxide (an average primary particle size of 24 nm) as an external additive, after which, the mixture was blended using a Henschel mixer (manufactured by Mitsui Miike Machinery Co., Ltd.) under the conditions of a circumferential rate of the mixing blades of 35 m/second, a treatment temperature of 35° C., and a treatment time of 15 minutes to carry out an external additive treatment to produce "cyan toner 1".

The shape and the particle size of the toner particle were not changed by the addition of the external additives.

<Production of Cyan Toners 11 and 12>: (Production of Toner by Pulverizing Method)

"Cyan toners 11 and 12", were produced in the similar manner to the production of "cyan toner 1" except that the coloring agent and the wax employed in the production of "cyan toner 1" were changed to those listed in Table 2.

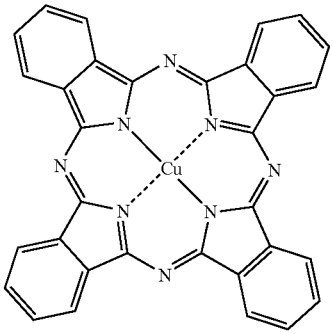

Copper Phthalocyanine

<Production of Cyan Toner 2>: (Production of Toner by Emulsion Coalescing Method)

(1) Preparation of Phthalocyanine Dispersion (2)

An aqueous surfactant solution was prepared by dissolving, with stirring, 7.0 parts by mass of n-sodium dodecyl sulfate into 160 parts by mass of ion-exchanged water. Into the above aqueous surfactant solution, 20 parts by mass of coloring agent "phthalocyanine (I-17)" was gradually added, which mixture was then subjected to a dispersion treatment employing CLEAR-MIX W-MOTION CLM-0.8 (produced by M-TECHNIQUE Co.) to prepare a coloring agent dispersion. The dispersion is denoted as "phthalocyanine dispersion (2)".

The particle size of the coloring agent in "phthalocyanine dispersion (2)" was determined to be 252 nm in the volume-based median size ($D_{50}$).

The volume-based median size ($D_{50}$) is a value determined employing MTCROTRACK UPA-150 (manufactured by Honeywell Inc.) under the following measurement conditions:

Refractive index of sample: 1.59

Specific gravity of sample: 1.05 (equivalent converted to spherical particle)

Refractive index of solvent: 1.33

Viscosity of solvent: 0.797 at 30° C., and 1.002 at 20° C. The zero-point adjustment was carried out via placing ion-exchanged water in the measurement cell.

(Preparation of Toner Particle)

(A) Preparation of Resin Particle for Core Part (a) The First Step Polymerization Into a reaction vessel provided with a mixer, a temperature sensor, a condenser and a nitrogen-introducing tube was introduced an aqueous surfactant solution in which 4 parts by mass of an anion surfactant, which is composed of a sodium dodecyl sulfate ($C_{10}H_{21}(OCH_2CH_2H)_2SO_3Na$), was dissolved into 3,040 parts by mass of ion-exchanged water. Then, in the above vessel, polymerization initiator solution in which 10 parts by mass of potassium persulfate (KPS) was dissolved into 400 parts by mass of ion-exchanged water was added, and then, after the temperature of the resulting solution was raised to 75° C. polymerizable monomer solution, which is composed of 532 parts by mass of styrene, 200 parts by mass of n-butyl acrylate, 68 parts by mass of methacrylic acid, and 16.4 parts by mass of n-octyl mercaptan, was added dropwise into the above vessel over one hour. After that, polymerization (the first step polymerization) was carried out by heating with stirring the resulting solution at 75° C. for 2 hours to prepare resin particle dispersion (1H) incorporating resin particles (1h).

Resin particles (1h) thus obtained exhibited a weight-average molecular weight of 16,500.

(b) The Second Step Polymerization

Into a flask equipped with a mixer was introduced a polymerizable monomer solution composed of 101.1 parts by mass of styrene, 62.2 parts by mass of n-butyl acrylate, 12.3 parts by mass of methacrylic acid, and 1.75 parts by mass of n-octyl mercaptan, followed by an addition of 93 parts by mass of microcrystalline wax, which mixture was then dissolved by heating the solution at 90° C. to prepare a monomer solution.

An aqueous surfactant solution was prepared by dissolving 3 parts by mass of the anion surfactant employed in the first step polymerization in 1,560 parts by mass of ion-exchanged water, which solution was then heated so that the temperature of the solution becomes 98° C. Into the resulting aqueous surfactant solution was added 32.8 parts by mass (equivalent converted to solids) of resin particles (1h) prepared at the first step polymerization, followed by an addition of the paraffin wax-containing monomer solution-After that, the resulting mixture was subjected to a mixed dispersion over 8 hours employing a mechanical disperser having a circulation pass, CLEARMIX (produced by M Technique Co.) to prepare an emulsified particle dispersion comprised of emulsion particles (oil droplets) exhibiting a dispersion particle size of 340 nm.

Subsequently, a polymerization initiator solution of 6 parts by mass of potassium persulfate dissolved in 200 parts by mass of ion-exchanged water was added into the above dispersion. By heating with stirring the resulting mixture at 98° C. over 12 hours, polymerization (the second step polymerization) was carried out to prepare resin particle dispersion (1HM) comprised of resin particles (1hm).

Resin particles (1hm) thus obtained exhibited a weight-average molecular weight of 23,000.

(c) The Third Step Polymerization

A polymerization initiator solution of 4.54 parts by mass of potassium persulfate dissolved in 220 parts by mass of ion-exchanged water was added into the resin particle dispersion (1HM) obtained at the second step polymerization. Into the resulting mixture was dropwise added at 80° C. over one hour a polymerizable monomer solution composed of 293.8 parts by mass of styrene, 154.1 parts by mass of n-butyl acrylate, and 7.08 parts by mass of n-octyl mercaptan. After completing addition, by heating with stirring the reaction mixture over 2 hours, polymerization (the third step polymerization) was carried out, after which the reaction mixture was cooled to 28° C. to obtain resin particle dispersion comprised of resin particles for core (2).

Resin particles for core (2) thus obtained exhibited a weight-average molecular weight of 26,800.

(B) Preparation of Resin Particle for Shell

"Resin particles for shell (2)" was prepared by polymerization in a similar manner to the first step polymerization except that 624 parts by mass of styrene, 120 parts by mass of 2-ethylhexyl acrylate, 56 parts by mass of methacrylic acid, and 16.4 parts by mass of n-octyl mercaptan were employed as polymerizable monomers in the above first step polymerization.

(C) Preparation of Toner Particle (a) Formation of Core (Step A)

Into a reaction vessel provided with a mixer, a temperature sensor, a condenser and a nitrogen-introducing tube was introduced 420.7 parts by mass of resin particles for core (2), 500 parts by mass of ion-exchanged water, and 60.5 parts by mass of "phthalocyanine dispersion (2)", which mixture was then stirred, and then the temperature of the mixture was regulated to 30° C. After that, the pH of the resulting mixture was adjusted to 10 with an aqueous 5 mol/liter sodium hydroxide solution.

(Step B)

Next, further thereto, an aqueous solution of 2 parts by mass of magnesium chloride hexahydrate dissolved in 1,000 parts by mass of ion-exchanged water was added with stirring at 30° C. over 10 minutes. After allowed to stand for 3 minutes, the temperature rise of the mixture was initiated, and in 60 minutes the mixture was heated to 75° C.

Subsequently, an average particle size of the coagulated particles was determined via "Coulter Multisizer 3", (manufactured by Beckman Coulter, Inc.), and at a time when the coagulated particles reached a volume-based median size ($D_{50}$) of 6.5 μm, there was added an aqueous solution of 8.2 parts by mass of sodium chloride dissolved in 50 parts by mass of ion-exchanged water to terminate the particle growth.

(Step C)

Further, heating with stirring was continued at the solution temperature of 80° C. over 4 hours to allow fusion to continue, whereby "core contained solution (2)" was obtained.

With respect to core contained solution (2) thus obtained, the average circularity was 0.940 measured by "FPIA2100" (manufactured by Systex Co.).

(b) Formation of Shell

After "core contained solution (2)" was adjusted to 65° C., 96 parts by mass of "resin particles for shell (2)" was added. Further, thereto, an aqueous solution of 2 parts by mass of magnesium chloride hexahydrate dissolved in 1,000 parts by mass of ion-exchanged water was added over 10 minutes, and the reaction mixture was heated to 70° C. and stirred over one hour. Thus, resin particles for shell (2) were fused on the surface of core part (1). After that, the shell was formed by a ripening treatment at the solution temperature of 75° C. over 20 hours to prepare "dispersion of toner matrix (2)".

After that, the dispersion of toner matrix (2) was cooled down to 30° C. at a condition of 8° C./min. With respect to toner matrix (2) thus obtained, the average circularity was 0.943 measured by "FPIA2100" (manufactured by Systex Co.).

(Steps of Washing and Drying)

Next, "dispersion of toner matrix (2)" was filtered, and further, washing with ion-exchanged water of 45° C. was repeated, and then dried with warm air of 40° C. to obtain "toner matrix particles 2". The volume-based median size ($D_{50}$) of "toner matrix particles 2" was 6.2 μm.

(Step of External Additive Treatment)

To toner matrix particles 2 thus obtained were added 0.6 parts by mass of silazane treated silica (an average primary particle size of 12 nm) and 0.8 parts by mass of octylsilane treated titanium oxide (an average primary particle size of 24 nm) as an external additive, and the reaction was subjected to an external addition treatment, in which the reaction was mixed employing a Henschel mixer (manufactured by Mitsui Miike Machinery Co., Ltd.) under conditions of a stirring circumferential rate of the mixing blades of 35 m/sec, a treatment temperature of 35° C., and a treatment time of 15 minutes, to produce "cyan toner 2".

The shape and the particle size of toner matrix particles 2 were not changed by the addition of the external additives.

<Production of Cyan Toners 3 to 10 and 15>: (Production of Toner by Emulsion Coalescing Method)

"Cyan toners 3 to 10 and 15" were produced in the similar manner to the production of "cyan toner 2" except that the coloring agent and the wax employed in the production of "cyan toner 2" were changed to those listed in Table 2.

<Production of Cyan Toners 13 and 14>: (Production of Toner by Emulsion Coalescing Method)

"Cyan toners 13 and 14" were produced in the similar manner to the production of "cyan toner 2" except that the coloring agent and the wax employed in the production of "cyan toner 2" were changed to those listed in Table 2.

In Table 2, colorants and waxes employed in the production of cyan toners are described.

TABLE 2

| Cyan Toner | Production Method | Coloring Agen: Exemplified Compound | Coloring Agen: Additive Amount (Parts by Mass) | Coloring Agen: Size of Dispersion (nm) | Wax | Wax: Additive Amount (Parts by Mass) | Toner: Average Circularity | Toner: Particle Size* (μm) |
|---|---|---|---|---|---|---|---|---|
| Cyan Toner 1 | *1 | I-1 | 5.5 | — | Wax 1 | 7.0 | — | 6.3 |
| Cyan Toner 2 | *2 | I-17 | 20.0 | 246 | Wax 2 | 93.0 | 0.968 | 6.4 |
| Cyan Toner 3 | *2 | I-3 | 21.0 | 239 | Wax 2 | 91.0 | 0.941 | 5.3 |
| Cyan Toner 4 | *2 | I-15 | 22.0 | 310 | Wax 2 | 88.5 | 0.943 | 7.2 |
| Cyan Toner 5 | *2 | I-7 | 18.0 | 198 | Wax 3 | 99.0 | 0.970 | 6.1 |
| Cyan Toner 6 | *2 | I-8 | 20.5 | 276 | Wax 2 | 90.0 | 0.940 | 5.2 |
| Cyan Toner 7 | *2 | I-9 | 19.5 | 282 | Wax 1 | 85.0 | 0.958 | 6.7 |
| Cyan Toner 8 | *2 | I-13 | 16.0 | 222 | Wax 3 | 87.8 | 0.971 | 6.3 |
| Cyan Toner 9 | *2 | I-5 | 17.5 | 211 | Wax 2 | 92.0 | 0.943 | 6.5 |
| Cyan Toner 10 | *2 | I-7 | 25.0 | 209 | Wax 1 | 95.0 | 0.951 | 5.1 |
| Cyan Toner 11 | *1 | I-1 | 5.0 | 287 | Wax 1 | 7.0 | — | 7.2 |
| Cyan Toner 12 | *1 | Copper Phthalocyanine | 5.5 | 256 | Wax 1 | 7.0 | — | 6.1 |
| Cyan Toner 13 | *2 | I-1 | 22.0 | 240 | Wax 1 | 93.0 | 0.957 | 5.2 |
| Cyan Toner 14 | *2 | Copper Phthalocyanine | 23.0 | 273 | Wax 1 | 93.0 | 0.943 | 6.7 |
| Cyan Toner 15 | *2 | I-2 | 20.1 | 23.2 | Wax 2 | 90.0 | 0.957 | 6.3 |

*Volume-Averaged Median Size ($D_{50}$),

Wax 1: Microcrystalline Wax

Wax 2: Behenyl Behenate,

Wax 3: Microcrystalline Wax (85 parts) + Behenyl Behenate (15 Parts),

*1: Pulverizing Method,

*2: Emulsion Coalescing Method

The circularity and the toner particle size are the values determined by the above-described methods.

<<Production of Magenta Toner>>

"Magenta toners 1 to 14" were produced in a similar way to the production of cyan toners except that coloring agents employed in the production of cyan toners 1 to 14 were changed to those described in Table 3.

In Table 3, colorants employed in the production of magenta toners are described.

TABLE 3

| Magenta Toner | Production Method | Coloring Agent: Exemplified Compound | Coloring Agent: Additive Amount (Parts by Mass) | Coloring Agent: Size of Dispersion (nm) | Toner: Average Circularity | Toner: Particle Size* (μm) |
|---|---|---|---|---|---|---|
| Magenta Toner 1 | Pulverizing Method | A-2 | 3.0 | — | — | 5.4 |
| Magenta Toner 2 | *1 | A-1 | 20.0 | 292 | 0.943 | 6.5 |
| Magenta Toner 3 | *1 | A-4 | 21.0 | 256 | 0.955 | 7.2 |
| Magenta Toner 4 | *1 | A-3 | 22.0 | 287 | 0.962 | 6.1 |
| Magenta Toner 5 | *1 | A-8 | 18.0 | 289 | 0.968 | 5.2 |
| Magenta Toner 6 | *1 | A-13 | 20.5 | 202 | 0.941 | 6.7 |
| Magenta Toner 7 | *1 | A-17 | 19.5 | 287 | 0.943 | 6.5 |
| Magenta Toner 8 | *1 | A-23 | 16.0 | 247 | 0.958 | 6.5 |
| Magenta Toner 9 | *1 | A-19 | 17.5 | 223 | 0.951 | 7.8 |
| Magenta Toner 10 | *1 | A-14 | 25.0 | 234 | 0.952 | 5.1 |
| Magenta Toner 11 | Pulverizing Method | PR122 | 3.0 | — | — | 5.5 |
| Magenta Toner 12 | Pulverizing Method | A-2 | 3.0 | — | — | 7.1 |
| Magenta Toner 13 | *1 | PR122 | 20.0 | 256 | 0.957 | 5.9 |
| Magenta Toner 14 | *1 | A-2 | 20.0 | 321 | 0.943 | 6.8 |

*Volume-Averaged Median Size ($D_{50}$),

*1: Emulsion Coalescing Method

<<Production of Yellow Toner>>

"Yellow toners 1 to 14" were produced in a similar way to the production of cyan toners except that coloring agents employed in the production of cyan toners 1 to 14 were changed to those described in Table 4.

In Table 4, colorants employed in the production of yellow toners are described.

TABLE 4

| | | Coloring Agent | | | Toner | |
|---|---|---|---|---|---|---|
| Yellow Toner | Production Method | Compound | Additive Amount (Parts by Mass) | Size of Dispersion (nm) | Average Circularity | Particle Size* (μm) |
| Yellow Toner 1 | Pulverizing Method | PY74 | 5.5 | — | — | 6.3 |
| Yellow Toner 2 | *1 | PY180 | 19.5 | 252 | 0.970 | 6.3 |
| Yellow Toner 3 | *1 | PY185 | 20.0 | 271 | 0.940 | 6.5 |
| Yellow Toner 4 | *1 | PY74*PY180 = 1:9 | 15.0 | 291 | 0.958 | 5.1 |
| Yellow Toner 5 | *1 | PY155 | 16.0 | 301 | 0.951 | 5.3 |
| Yellow Toner 6 | *1 | PY180:PY139 = 2:8 | 17.5 | 210 | 0.943 | 5.2 |
| Yellow Toner 7 | *1 | PY74:PY139 = 1:9 | 19.5 | 229 | 6.971 | 6.7 |
| Yellow Toner 8 | *1 | PY139:155 = 5:5 | 16.0 | 234 | 0.971 | 6.3 |
| Yellow Toner 9 | *1 | PY155:PY180 = 5:5 | 17.5 | 199 | 0.943 | 6.5 |
| Yellow Toner 10 | *1 | PY155:PY185 = 5:5 | 25.0 | 254 | 0.951 | 5.1 |
| Yellow Toner 11 | Pulverizing Method | PY17 | 5.0 | — | — | 7.2 |
| Yellow Toner 12 | Pulverizing Method | PY17 | 5.5 | — | — | 6.1 |
| Yellow Toner 13 | *1 | PY17 | 22.0 | 250 | 0.957 | 5.2 |
| Yellow Toner 14 | *1 | PY17 | 23.0 | 239 | 0.943 | 6.7 |

*Volume-Averaged Median Size ($D_{50}$),
*1: Emulsion Coalescing Method

<<Preparation of Cyan Developing Agent>>

Ferrite carriers, exhibiting a volume-average particle size of 60 μm, covered with silicone resins, were blended into each of "cyan toners 1 to 14" so that the concentration of the above each cyan toner became 6% by mass to prepare "cyan developing agents 1 to 14".

<<Preparation of Magenta Developing Agent>>

Ferrite carriers, exhibiting a volume-average particle size of 60 μm, covered with silicone resins, were blended into magenta each of "magenta toners 1 to 14" so that the concentration of the above each magenta toner became 6% by mass to prepare "magenta developing agents 1 to 14".

<<Preparation of Yellow Developing Agent>>

Ferrite carriers, exhibiting a volume-average particle size of 60 μm, covered with silicone resins, were blended into each of "yellow toners 1 to 14" so that the concentration of the above each yellow toner became 6% by mass to prepare "yellow developing agents 1 to 14".

<<Evaluation><Evaluation of Color Gamut>

As an image forming apparatus for evaluation, a commercially available digital copier, "bizhub PRO C6500" (manufactured by Konica Minolta Business Technologies, Inc.), was prepared.

For evaluation of color gamut, each color toner and each color developing agent, both of which were prepared above, were sequentially charged into the above prepared image forming apparatus, and then, a test chart for color region measurement was printed at default mode employing a glossy paper sheet under an environment of 20° C. and 50% RH. In that case, regarding a black toner, a commercially available one, attached to the above image forming apparatus, was employed.

For the color gamut, employing Spectrolina/Scan•Bundle (produced by GretagMacbeth, Inc.), the outputted Lest chart for the color gamut measurement was measured in accordance with the following measurement conditions:

(Measurement Conditions for Color Gamut)
Observing light source: D50
Observing angle: 2°
Density: ANSI T
White reference: Abs
Filter: UV•Cut
Measurement mode: reflectance Comparative toners (toners 12 and 14 for each color) are constituted of Y=P.Y.74/M=P.R.122/C=P.B.15:3, and the color gamut was designated as 100.

Table 5 shows yellow toner, magenta toner, cyan toner, and black toner, which were employed for forming full-color images.

TABLE 5

| | Toner | | | |
|---|---|---|---|---|
| | Yellow Toner | Magenta Toner | Cyan Toner | Black Toner |
| Example 1 | Yellow Toner 1 | Magenta Toner 1 | Cyan Toner 1 | Commercial Black Toner |
| Example 2 | Yellow Toner 2 | Magenta Toner 2 | Cyan Toner 2 | Commercial Black Toner |
| Example 3 | Yellow Toner 3 | Magenta Toner 3 | Cyan Toner 3 | Commercial Black Toner |
| Example 4 | Yellow Toner 4 | Magenta Toner 4 | Cyan Toner 4 | Commercial Black Toner |
| Example 5 | Yellow Toner 5 | Magenta Toner 5 | Cyan Toner 5 | Commercial Black Toner |
| Example 6 | Yellow Toner 6 | Magenta Toner 6 | Cyan Toner 6 | Commercial Black Toner |
| Example 7 | Yellow Toner 7 | Magenta Toner 7 | Cyan Toner 7 | Commercial Black Toner |
| Example 10 | Yellow Toner 8 | Magenta Toner 8 | Cyan Toner 8 | Commercial Black Toner |
| Example 11 | Yellow Toner 9 | Magenta Toner 9 | Cyan Toner 9 | Commercial Black Toner |
| Example 12 | Yellow Toner 10 | Magenta Toner 10 | Cyan Toner 10 | Commercial Black Toner |
| Example 13 | Yellow Toner 7 | Magenta Toner 4 | Cyan Toner 15 | Commercial Black Toner |
| Comparative Example 1 | Yellow Toner 11 | Magenta Toner 11 | Cyan Toner 11 | Commercial Black Toner |
| Comparative Example 2 | Yellow Toner 12 | Magenta Toner 12 | Cyan Toner 12 | Commercial Black Toner |

TABLE 5-continued

| | Toner | | | |
|---|---|---|---|---|
| | Yellow Toner | Magenta Toner | Cyan Toner | Black Toner |
| Comparative Example 3 | Yellow Toner 13 | Magenta Toner 13 | Cyan Toner 13 | Commercial Black Toner |
| Comparative Example 4 | Yellow Toner 14 | Magenta Toner 14 | Cyan Toner 14 | Commercial Black Toner |

As shown from the results in Table 6, any prints made of "Examples 1 to 13", which fill structures of the image forming methods of the present invention, resulted in 20% to 25% larger color gamut, compared to prints made of "Comparative Examples 1 to 4", in which toners employing conventional coloring materials were combined.

<Evaluation of Color Gamut Balance>

In order to compare a color gamut balance based on data obtained at the above <Evaluation of Color Gamut>, chromas at every 90 degrees of hue, that is, at 45 degrees, at 135 degrees, at 225 degrees, and at 315 degrees, are described in Table 6 below. For a comparison, data of sRGB are described in Table 6.

<Sensory Evaluation of Images>

Test charts for color sensory test were printed with similar toner combinations employing the above commercially available digital copier "bizhub PRO C6500" (manufactured by Konica Minolta Business Technologies, Inc.) Visual sensory evaluations were carried out using the above test charts by 50 persons, and images were scored in accordance with the following criteria:

The sensory evaluations of images were carried out with the total points made by all 50 persons. Images with a score of 180 or more are evaluated as acceptable.

Evaluation Criteria 4 points: The image looks beautiful.

3 points: The image looks somewhat beautiful.

2 points: The image gives an average impression.

1 point: The image has a color imbalance.

Table 6 shows the evaluation results.

TABLE 6

| | Evaluation Result | | | | | |
|---|---|---|---|---|---|---|
| | | Color Gamut Balance | | | | |
| | Area of Color Gamut (Index) | Chroma at Hue Angle of 45° | Chroma at Hue Angle of 135° | Chroma at Hue Angle of 225° | Chroma at Hue Angle of 315° | Sensory Test of Image (Score) |
| Example 1 | 132 | 79 | 85 | 58 | 91 | 190 |
| Example 2 | 134 | 80 | 86 | 58 | 93 | 191 |
| Example 3 | 135 | 78 | 87 | 57 | 95 | 198 |
| Example 4 | 131 | 81 | 84 | 56 | 91 | 193 |
| Example 5 | 132 | 82 | 85 | 57 | 91 | 184 |
| Example 6 | 132 | 78 | 85 | 59 | 92 | 188 |
| Example 7 | 133 | 79 | 86 | 58 | 93 | 198 |
| Example 10 | 135 | 80 | 87 | 57 | 95 | 182 |
| Example 11 | 130 | 80 | 84 | 56 | 91 | 189 |
| Example 12 | 132 | 80 | 85 | 57 | 92 | 188 |
| Example 13 | 137 | 80 | 88 | 61 | 95 | 199 |
| Comparative Example 1 | 100 | 79 | 78 | 58 | 75 | 77 |
| Comparative Example 2 | 110 | 80 | 75 | 55 | 79 | 80 |
| Comparative Example 3 | 100 | 80 | 79 | 58 | 70 | 75 |
| Comparative Example 4 | 109 | 79 | 74 | 56 | 78 | 83 |
| | Color Gamut of sRGB | 100 | 120 | 40 | 120 | 131 |

As shown in Table 6, any prints, which employ toners of the present invention and were produced by a method for forming full-color images, resulted in larger color gamut, compared to prints obtained in combination of toners composed of conventional coloring materials. Further, the above prints exhibited color gamuts with a better color gamut balance compared to those of sRGB, and also excellent results in the sensory tests.

What is claimed is:

1. A set of toners comprising a yellow toner, a magenta toner, a cyan toner and a black toner for forming a full color image with an electrophotographic method, wherein the yellow toner comprises toner particles containing at least one pigment selected from the group consisting of C. I. Pigment Yellow 74, C. I. Pigment Yellow 139, C. I. Pigment Yellow 180, C. I. Pigment Yellow 185 and C. I. Pigment Yellow 155;

the magenta toner comprises toner particles containing a rhodamine based dye represented at least by Formula (1) and Formula (2), and the cyan toner comprises toner particles containing a phthalocyanine based dye represented by Formula (5):

Formula (1)

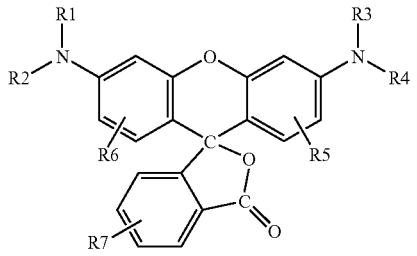

wherein R1 to R4 and R5 to R7 each independently represents a hydrogen atom or an alkyl group of 1 to 4 carbon atoms;

Formula (2)

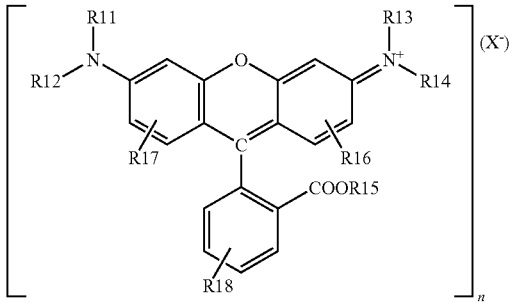

wherein R11 to R14 and R16 to R18 each independently represents a hydrogen atom or an alkyl group of 1 to 4 carbon atoms, R15 represents a hydrogen atom or an alkyl group of 1 to 12 carbon atoms, ($X^-$) represents a counter anion represented by any one of a chlorine ion, a bromine ion, a sulfate ion, Formula (3) and Formula (4), and n is an integer of 1 or 2;

Formula (3)

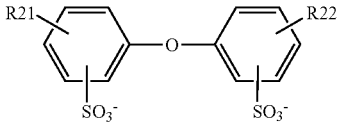

wherein R21 and R22 each independently represents an alkyl group of 1 to 22 carbon atoms;

Formula (4)

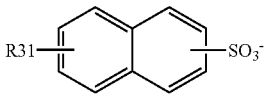

wherein R31 represents an alkyl group of 1 to 22 carbon atoms;

Formula (5)

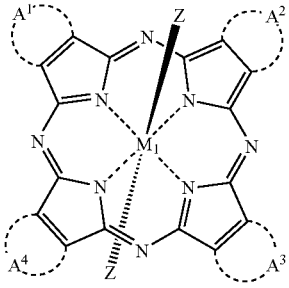

wherein $M_1$ represents any one of silicon atom, germanium atom, tin atom; each Z independently represents a hydroxyl group, a chlorine atom, an aryloxy group of 6 to 18 carbon atoms, an alkoxy group of 1 to 22 carbon atoms and a group represented by Formula (6); $A^1$, $A^2$, $A^3$ and $A^4$ each independently represents a methyl group or an atomic group which forms an aromatic group having electron controllable group; and Formula (6)

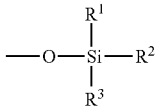

wherein $R^1$, $R^2$, $R^3$ represents an alkyl group of 1 to 22 carbon atoms, an aryl group of 6 to 18 carbon atoms, an alkoxy group of 1 to 22 carbon atoms or an aryloxy group of 6 to 18 carbon atoms and $R^1$, $R^2$, $R^3$ each may be the same or different.

2. The set of toners of claim 1, wherein $M_1$ in Formula (5) comprises a silicon atom.

3. The set of toners of claim 1, wherein A1, A2, A3, and A4 in Formula (5) all comprises atom groups forming a benzene ring.

4. The set of toners of claim 1, wherein Z comprises a group represented by Formula (6).

5. The set of toners of claim 4, wherein $R^1$, $R^2$, $R^3$ in Formula (6) each independently comprises an alkyl group of 1 to 22 carbon atoms.

6. The set of toners of claim 4, wherein $R^1$, $R^2$, $R^3$ in Formula (6) each independently comprises an alkyl group of 1 to 6 carbon atoms.

7. The set of toners of claim 1, wherein R5, R6, R7 in Formula (1) each comprises a hydrogen atom.

8. The set of toners of claim 1, wherein R16, R17, R18 in Formula (2) each comprises a hydrogen atom.

9. The set Of toners of claim 1, wherein R15 in Formula (2) each comprises a hydrogen atom or an alkyl group of 1 to 4 carbon atoms.

10. An electrophotographic image forming apparatus comprising the set of toners of claim 1.

11. A method for forming a color image using the electrophotographic image forming apparatus of claim 10.

* * * * *